US010980696B2

(12) United States Patent
Dickie et al.

(10) Patent No.: US 10,980,696 B2
(45) Date of Patent: Apr. 20, 2021

(54) LIMB STRETCHING DEVICE

(71) Applicants: TAO LIFE SCIENCES INC., Greenville, SC (US); Prisma Health-Upstate, Greenville, SC (US); Katherine Henson, Greenville, SC (US); Nicholas Rierson, Greenville, SC (US); John Calvert, Greenville, SC (US); Victor DePiero, Louisville, KY (US)

(72) Inventors: Robert Dickie, Greenville, SC (US); Elizabeth Dubose, Greenville, SC (US); Katherine Henson, Greenville, SC (US); Nicholas Rierson, Greenville, SC (US); John Calvert, Greenville, SC (US); Victor DePiero, Louisville, KY (US)

(73) Assignees: TAO LIFE SCIENCES INC., Seneca, SC (US); PRISMA HEALTH-UPSTATE, Greenville, SC (US)

( * ) Notice: Subject to any disclaimer, the term of this patent is extended or adjusted under 35 U.S.C. 154(b) by 235 days.

(21) Appl. No.: 16/070,263

(22) PCT Filed: Jan. 17, 2017

(86) PCT No.: PCT/US2017/013767
§ 371 (c)(1),
(2) Date: Jul. 13, 2018

(87) PCT Pub. No.: WO2017/124093
PCT Pub. Date: Jul. 20, 2017

(65) Prior Publication Data

US 2019/0015285 A1 Jan. 17, 2019

Related U.S. Application Data

(60) Provisional application No. 62/279,581, filed on Jan. 15, 2016.

(51) Int. Cl.
*A61H 1/02* (2006.01)

(52) U.S. Cl.
CPC ..... *A61H 1/0266* (2013.01); *A61H 1/02* (2013.01); *A61H 1/0285* (2013.01);
(Continued)

(58) Field of Classification Search
CPC ..... A61H 1/0266; A61H 1/02; A61H 1/0285; A61H 2201/1463; A61H 2201/1253;
(Continued)

(56) References Cited

U.S. PATENT DOCUMENTS 2,216,764 A 10/1940 Clark et al.
4,186,920 A * 2/1980 Fiore ..... A63B 22/18 403/138

(Continued)

FOREIGN PATENT DOCUMENTS

CN 102387769 A 3/2012
CN 103027823 A 4/2013

(Continued)

OTHER PUBLICATIONS

International Search Report and Written Opinion issued in International Application No. PCT/US2017/013767, dated Mar. 17, 2017.

(Continued)

*Primary Examiner* — Victoria Murphy
*Assistant Examiner* — Arielle Wolff
(74) *Attorney, Agent, or Firm* — Meunier Carlin & Curfman LLC

(57) ABSTRACT

Various implementations include a device for assisting with and controlling stretching of a limb of a patient. The device includes a limb support for receiving the limb, a base, and a coupling that rotatably couples the limb support and the base. The coupling allows the limb support to rotate through various axes of rotation individually, depending on the range (Continued)

of motion expected for the limb. For example, for a device designed for the foot, the coupling allows a foot support to rotate about a first axis, a second axis, and a third axis, wherein the three axes are orthogonal to each other. In other implementations, the device may be designed for other portions of limbs, such as the hand, the forearm, the upper arm, the lower leg, and the upper leg.

22 Claims, 27 Drawing Sheets

(52) U.S. Cl.
CPC ..... *A61H 2201/1253* (2013.01); *A61H 2201/1409* (2013.01); *A61H 2201/1463* (2013.01); *A61H 2201/1635* (2013.01); *A61H 2201/1642* (2013.01); *A61H 2201/1673* (2013.01); *A61H 2201/5056* (2013.01)

(58) Field of Classification Search
CPC .... A61H 2201/1409; A61H 2201/1635; A61H 2201/1642; A61H 2201/1673; A61H 2201/5056; A61H 1/0237; Y10T 403/32041; Y10T 403/32049; F16C 11/04; F16C 11/045
See application file for complete search history.

(56) References Cited

U.S. PATENT DOCUMENTS

| | | | | |
|---|---|---|---|---|
| 5,170,776 | A * | 12/1992 | Pecheux ..... | A61H 1/0266 601/104 |
| 5,352,185 | A | 10/1994 | Blauth et al. | |
| 5,474,520 | A | 12/1995 | Bittikofer et al. | |
| 6,277,057 | B1 | 8/2001 | Hayden | |
| 2014/0348572 | A1 * | 11/2014 | Matsuzawa ..... | E04B 1/19 403/57 |

FOREIGN PATENT DOCUMENTS

| | | | |
|---|---|---|---|
| CN | 203520744 | U | 4/2014 |
| CN | 104760054 | A | 7/2015 |
| WO | 2010092497 | A1 | 9/2010 |

OTHER PUBLICATIONS

International Preliminary Report on Patentability issued in International Application No. PCT/US2017/013767, dated Jul. 26, 2018.
International Search Report, dated Mar. 17, 2018, received in connection with International Patent Application No. PCT/US2017/013767.
Extended European Search Report issued in EP 17739150.5, dated Jul. 23, 2019.
English Translation of a portion of the First Office Action issued in CN 2017800168042, dated Jul. 3, 2020.

* cited by examiner

LIMB STRETCHING DEVICE

BACKGROUND

Patients having paralysis or recovering from a physical injury to a limb may need physical therapy to restore normal range of motion or improve range of motion for a joint or limb. The therapy may include regularly stretching the limb (e.g., via the ankle or wrist joints). The limb is moved through its various stretches manually by a physical therapist or other caregiver until the normal range of motion of the limb is restored. For example, if there is an injury to the foot or leg, the foot may be stretched relative to the lower leg by twisting the forefoot side to side relative to the ankle joint within a horizontal plane, rolling the medial and lateral sides of the foot up and down, and flexing the forefoot in the plantar (downward) and dorsal (upward) directions relative to the heel.

Manual manipulation may have several drawbacks. First, the therapist or caregiver may over extend the limb past its normal range of motion, especially for patients having paralysis in the limb. This over extension can injure the patient or prevent recovery. Second, the movement may not be around the correct axis, which can slow recovery or cause other injury.

Thus, a device for assisting with and controlling stretching of a limb of a patient is needed.

BRIEF SUMMARY

Various implementations include a device that includes a foot support having an upper surface and a lower surface, a base, and a coupling disposed between the base and the lower surface of the foot support adjacent the heel portion of the foot support. The upper and lower surfaces of the foot support are spaced apart and opposite each other. The foot support includes a proximal end, a distal end opposite and spaced apart from the proximal end, a first side, and a second side opposite and spaced apart from the first side. The first and second sides extend between the proximal and distal ends. The foot support further includes a heel portion adjacent the proximal end. The coupling has a first axis of rotation, a second axis of rotation, and a third axis of rotation, and the axes are orthogonal to the each other. A first foot support axis extends between the proximal and distal ends of the foot support and is rotatable about the first axis and the third axis, and a second foot support axis that extends between the first and second sides of the foot support is rotatable about the second axis.

In some implementations, the foot support is rotatable about the coupling and at least one of the three axes between a neutral position and a plurality of rotated positions. The neutral position includes the first foot support axis being orthogonal to the first axis and the third axis and parallel to the second axis, and the second axis of rotation is parallel to the third axis and orthogonal to the first axis and second axis. The rotated positions include a twisting rotated position, a rolling rotated position, and a flexing rotated position. In the twisting rotated position, the first foot support axis is rotated about the first axis such that the first foot support axis and the second axis are in parallel planes and an angle between the first foot support axis and the second axis is greater than 0°. In the rolling rotated position, the second foot support axis is rotated about the second axis such that the second foot support axis and the third axis are in parallel planes and an angle between the second foot support axis and the third axis is greater than 0°. And, in the flexing rotated position, the first foot support axis is rotated about the third axis such that the first foot support axis and the second axis are in parallel planes and an angle between the first foot support axis and the second axis is greater than 0°.

In a further implementation, the coupling includes a universal joint that includes a center portion, a proximal arm, a distal arm, a first side arm, and a second side arm. The proximal arm and distal arm extend in opposite directions along the second axis, and the first side arm and the second side arm extend in opposite directions along the third axis.

In yet a further implementation, the coupling includes a bearing disposed between the center portion of the universal joint and the lower surface of the foot support. The first axis extends through the bearing and the center portion.

In a further implementation, the coupling also includes a first universal joint support member and a second universal joint support member. The first and second universal joint support members are fixedly coupled to the lower surface of the foot support. The first universal joint support member defines an opening for receiving the proximal arm of the universal joint, and the second universal joint support member defines an opening for receiving the distal arm of the universal joint.

In a further implementation, the coupling includes a third universal joint support member and a fourth universal joint support member. The third and fourth universal joint support members are fixedly coupled to the base. The third universal joint support member defines an opening for receiving the first side arm of the universal joint, and the fourth universal joint support member defines an opening for receiving the second side arm of the universal joint.

In some implementations, the device also includes a first lock for preventing rotation of the foot support about the first axis. For example, in certain implementations, the first lock includes a removable pin, an opening defined by the base, and an opening adjacent a proximal end of the foot support. The pin is removably engagable into the openings defined by the base and the proximal end of the foot support to prevent rotation about the first axis.

In further or additional implementations, the device includes a second lock for preventing rotation of the foot support about the second axis. For example, in certain implementations, the second lock includes a closed loop pneumatic system that includes a rod having a distal end coupled to the third axis of the coupling via a linkage and a proximal end moveable within a pneumatic cylinder. The pneumatic cylinder has a first port adjacent a distal end of the cylinder and a second port adjacent a proximal end of the cylinder, and the pneumatic system further includes conduits in fluid communication between the first and second ports and each end of an expansion bladder and in fluid communication with a valve. Movement of the proximal end of the rod toward the proximal end of the cylinder causes gas in the system to expand the bladder. The second lock prevents movement of the foot support about the second axis when the valve is closed, and the second lock provides resistance to and allows rotation of the foot support about the second axis when the valve is open, according to certain implementations.

In further or additional implementations, the device includes a third lock for preventing rotation of the foot support about the third axis. For example, in certain implementations, the third lock includes a closed loop pneumatic system that includes a rod having a distal end coupled to the second axis of the coupling via a linkage and a proximal end moveable within a pneumatic cylinder. The pneumatic cylinder has a first port adjacent a distal end of the cylinder and a second port adjacent a proximal end of the cylinder, and the pneumatic system further includes conduits in fluid communication between the first and second ports and each end of an expansion bladder and in fluid communication with a valve. Movement of the proximal end of the rod toward the proximal end of the cylinder causes gas in the system to expand the bladder. The third lock prevents movement of the foot support about the third axis when the valve is closed, and the third lock provides resistance to and allows rotation of the foot support about the third axis when the valve is open.

In further or additional implementations, the device includes first and second rotational stops. The first and second rotational stops are disposed on the base such that first and second rotational stops limit the angle through which the first foot support axis is able to rotate about the first axis from the neutral position to the twisted rotated position. For example, in certain implementations, the angle through which the first foot support axis is able to rotate about the first axis from the neutral position to the twisting rotated position is about 30° from each side of the neutral position.

In further or additional implementations, the device includes third and fourth rotational stops. The third and fourth rotational stops are disposed adjacent the lower surface of the foot support such that the third and fourth rotational stops limit the angle through which the second foot support axis is able to rotate about the second axis from the neutral position to the rolling rotated position. For example, in certain implementations, the angle through which the second foot support axis is able to rotate about the second axis from the neutral position to the rolling rotated position is about 30° from each side of the neutral position.

In further or additional implementations, the device includes fifth and sixth rotational stops. The fifth and sixth rotational stops are disposed on the base such that the fifth and sixth rotational stops limit the angle through which the first foot support axis is able to rotate about the third axis from the neutral position to the flexing rotated position. For example, in certain implementations, the angle through which the first foot support axis is able to rotate about the third axis from the neutral position to the flexing rotated position is about 30° in a direction in which the distal end of the foot support is moved upwardly from the neutral position and about 50° in a direction in which the distal end is moved downwardly from the neutral position.

In further or additional implementations, the foot support includes a plurality of strap supports adjacent the proximal end and a middle region of the foot support. The middle region is between the proximal end and a distal end of the foot support. The strap supports define openings for receiving one or more straps to secure a user's foot adjacent the upper surface of the foot support. The strap supports adjacent the middle region include a medial strap support and a lateral strap support. The medial and lateral strap supports are configured to slide inwardly toward or outwardly from the medial and lateral sides of the user's foot disposed on the foot support.

In further or additional implementations, the foot support includes a first boss adjacent a distal side of the foot support and a second boss adjacent one of the medial or lateral side of the foot support. The first boss has an axis that is parallel to the second axis, and the second boss having an axis that is parallel to the third axis. The bosses are configured for removably receiving a handle for manipulating rotation of the foot support about the three axes.

In further or additional implementations, the foot support includes a handle extending from the distal end.

In further or additional implementations, the base includes a lower support and an upper support that extends between the lower support and the coupling. In certain implementations, for example, the upper support includes an arm. For example, in some implementations, the arm is a main arm and the base further comprises a swing arm. The swing arm has a first portion that is coupled between the coupling and the lower surface of the foot support and a second portion that extends between the first portion and a free end. The free end of the swing arm is configured for swinging right or left in response to rotating the foot support about the second axis or backward and forward in response to rotating the foot support about the third axis. In further implementations, the coupling includes an opening defined by the first portion of the swing arm, a boss extending from the lower surface of the foot support that extends through the opening defined by the first portion of the swing arm, a protrusion that extends from the center portion of coupling, and a bearing disposed between an outer surface of the boss and the opening of the first portion of the swing arm. For example, in some implementations, the coupling further includes a second bearing disposed between the protrusion and an inner surface of the boss.

In further or additional implementations, the device also includes a first lock that includes a removable pin, an opening defined by the swing arm, and an opening adjacent a proximal end of the foot support. The pin is removably engagable into the openings defined by the swing arm and the proximal end of the foot support to prevent rotation about the first axis. In addition, in further or additional implementations, the cylinder of the closed loop pneumatic system of the second lock is coupled to the swing portion of the swing arm. And, in further or additional implementations, the pneumatic cylinder of the closed loop pneumatic system of the third lock is coupled to the lower support at a proximal end of the pneumatic cylinder.

DETAILED DESCRIPTION

Various implementations of the invention include a stretching device for assisting with and controlling stretching of a limb of a patient. The device includes a limb support for receiving the limb, a base, and a coupling that rotatably couples the limb support and the base. The coupling allows the limb support to rotate through various axes of rotation individually, depending on the range of motion expected for the limb. For example, for a device designed for the foot, the coupling allows a foot support to rotate about a first axis, a second axis, and a third axis, wherein the three axes are orthogonal to each other. The coupling is disposed between the base and the lower surface of the foot support adjacent a heel portion of the foot support, which is adjacent a proximal end of the foot support. In other implementations, the device may be designed for other portions of limbs, such as the hand, the forearm, the upper arm, the lower leg, and the upper leg.

Figure 1:
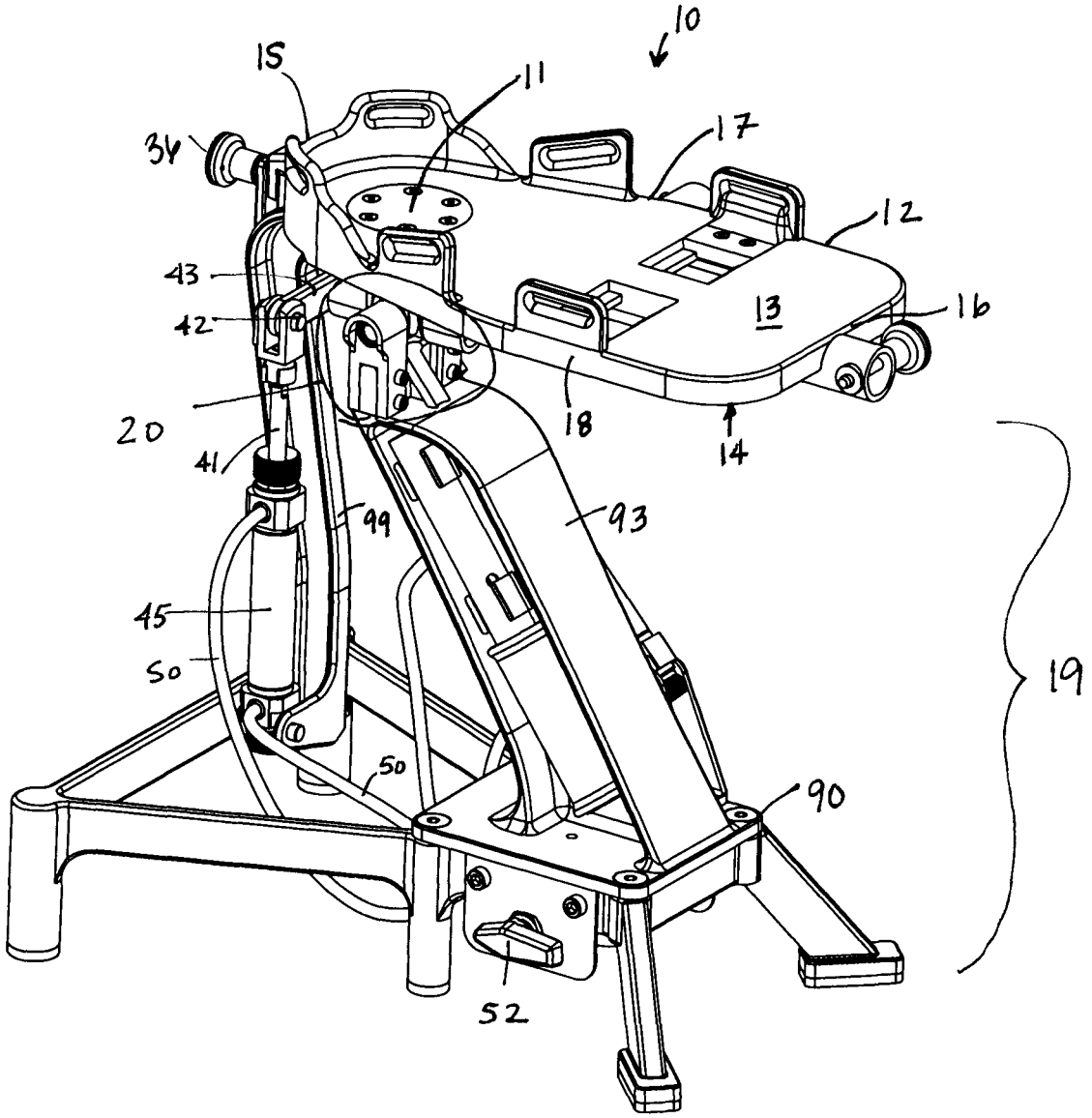
FIG. 1 is a front perspective view of a stretching device according to one implementation.
Figure 2:
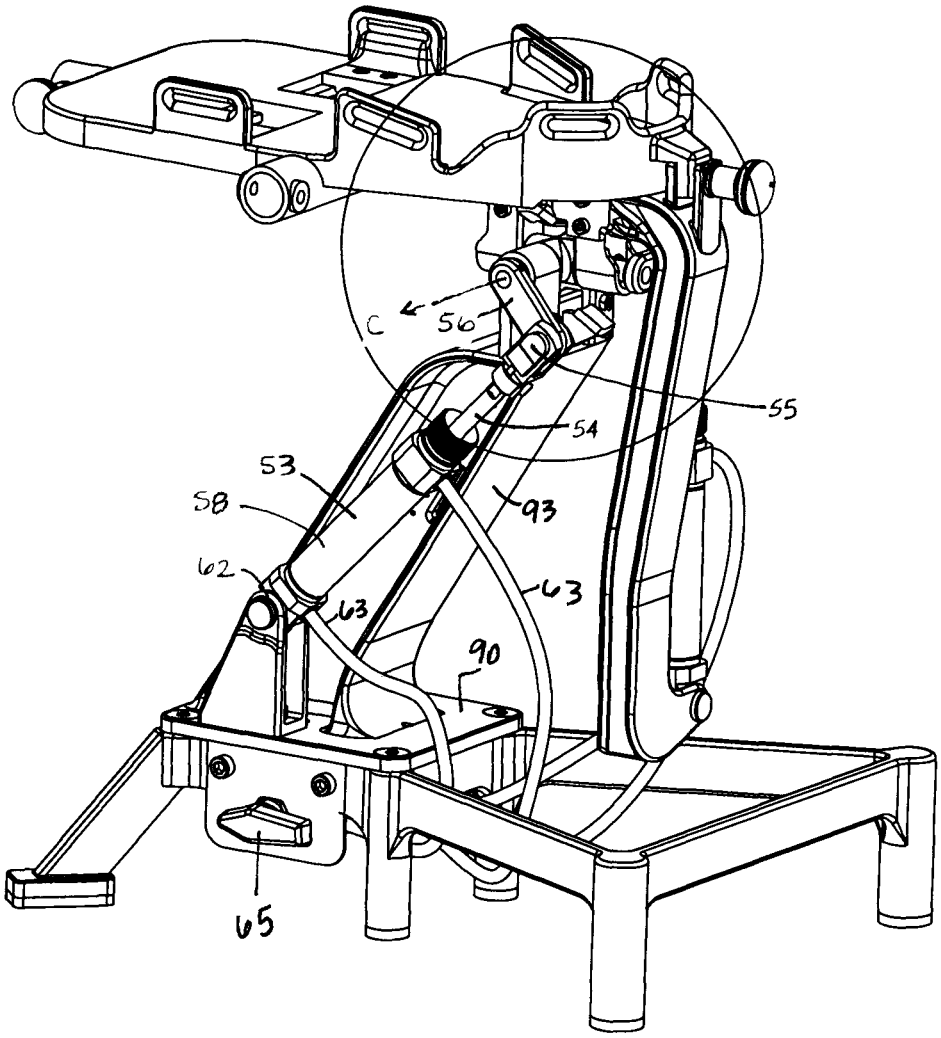
FIG. 2 is a rear, perspective view of the stretching device in FIG. 1.

For example, FIG. 1 illustrates a lower limb stretching device 10 according to one implementation. The stretching device 10 includes a foot support 12, a base 19, and a coupling 20. The foot support 12 includes an upper surface 13 and a lower surface 14 that are spaced apart and opposite each other, a proximal end 15 and a distal end 16 that are opposite and spaced apart from each other, and a first side 17 and a second side 18 that are opposite and spaced apart from each other and extend between the proximal 15 and distal ends 16. A heel portion 11 of the foot support 12 is adjacent the proximal end 15 and is configured for receiving the heel of the patient.

Figure 20:
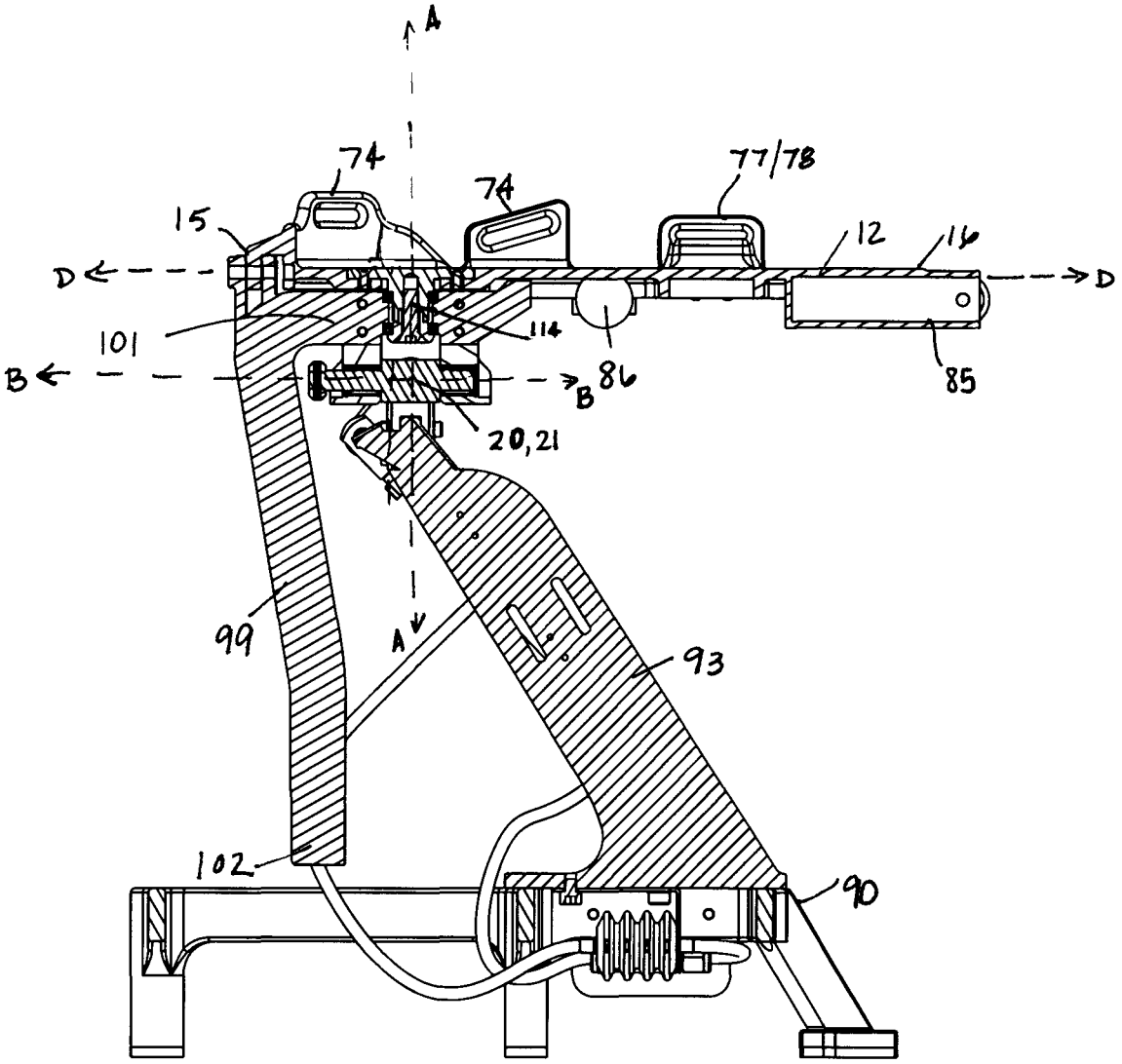
FIG. 20 is a cross sectional view of the stretching device of FIG. 1 taken along the F-F line in FIG. 3.
Figure 21:
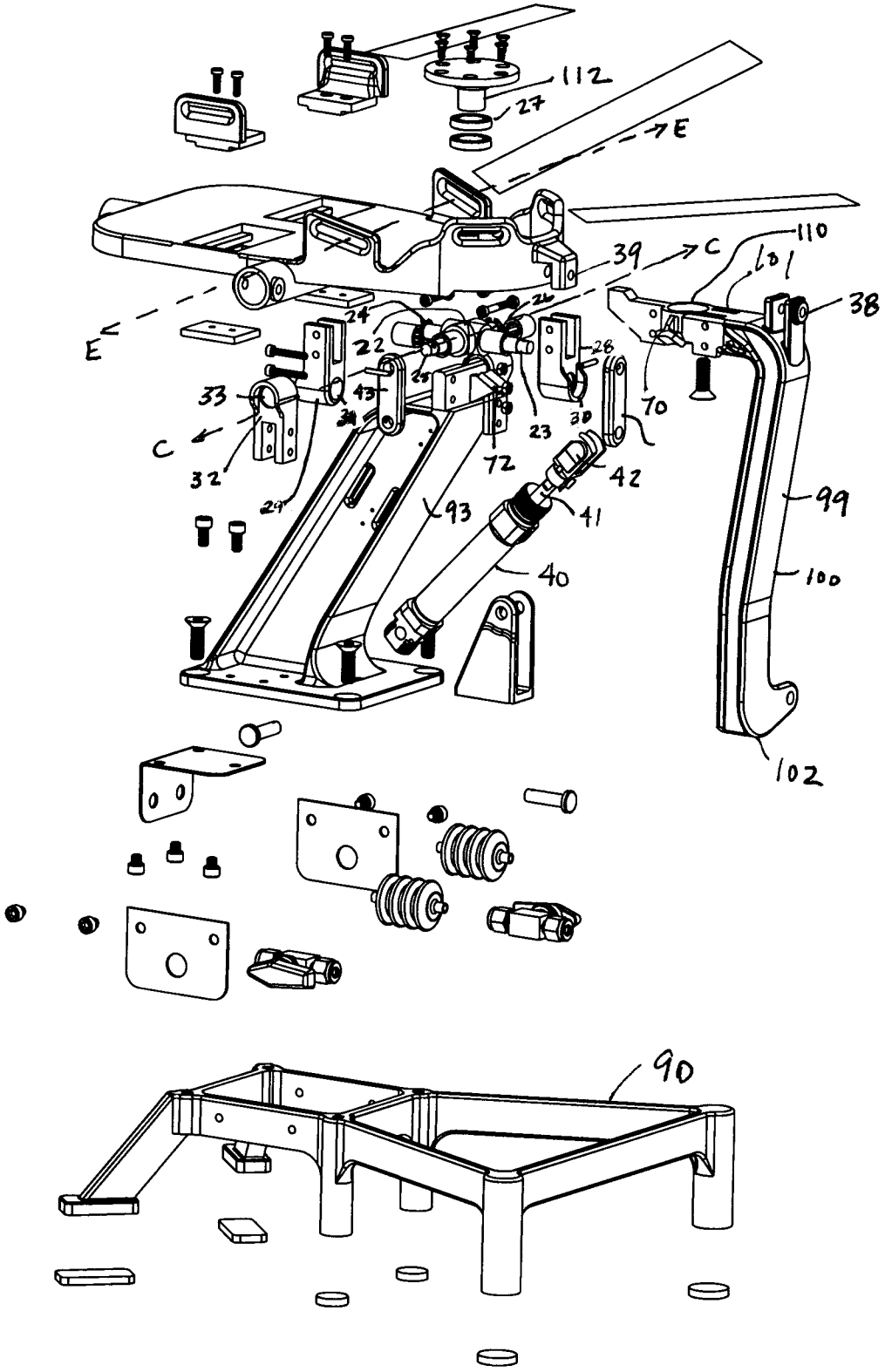
FIG. 21 is an exploded view of the stretching device of FIG. 1.

As shown in FIGS. 20 and 21, the coupling 20 rotatably couples the base 19 and the lower surface 14 of the foot support 12 adjacent the heel portion 11 of the foot support 12, directly or indirectly. The coupling 20 has a first axis of rotation A-A, a second axis of rotation B-B, and a third axis of rotation C-C, and the axes are orthogonal to each other. A first foot support axis D-D extends between the proximal 15 and distal ends 16 of the foot support 12 and is rotatable about the first axis A-A and the third axis C-C, and a second foot support axis E-E extends between the first 17 and second sides 18 of the foot support 12 and is rotatable about the second axis B-B.

In the implementation shown in FIGS. 1, 20, and 21, the coupling 20 includes a universal joint 21, a bearing 27, a first universal joint support member 28, a second universal joint support member 29, a third universal joint support member 32, and a fourth universal joint support member (not shown). The universal joint 21 includes a center portion 22, a proximal arm 23, a distal arm 24, a first side arm 25, and a second side arm 26. The proximal arm 23 and distal arm 24 extend in opposite directions along the second axis B-B, and the first side arm 25 and the second side arm 26 extend in opposite directions along the third axis C-C.

The first universal joint support member 28 and the second universal joint support member 29 are fixedly coupled to the lower surface 14 of the foot support 12 and each define an opening. The opening 30 of the first universal joint support member 28 receives the proximal arm 23 of the universal joint 21, and the opening 31 of the second universal joint support member 29 receives the distal arm 24 of the universal joint 21. The arms 23, 24 rotate within the openings 30, 31, respectively, along the second axis B-B. The third universal joint support member 32 and the fourth universal joint support member (not shown) are fixedly coupled to the base 19 and each define an opening. The opening 33 of the third universal joint support member 32 receives the first side arm 25 of the universal joint 21, and the opening of the fourth universal joint support member receives the second side arm 26 of the universal joint 21. The arms 25, 26 rotate within the openings along the third axis C-C. And, because the first 28 and second universal joint support members 29 are fixedly coupled to the foot support 12 and the third 32 and fourth universal joint support members are fixedly coupled to the base 19, the foot support 12 may be rotated about the second axis B-B independently of being rotated about the third axis C-C, and vice versa.

Figure 14:
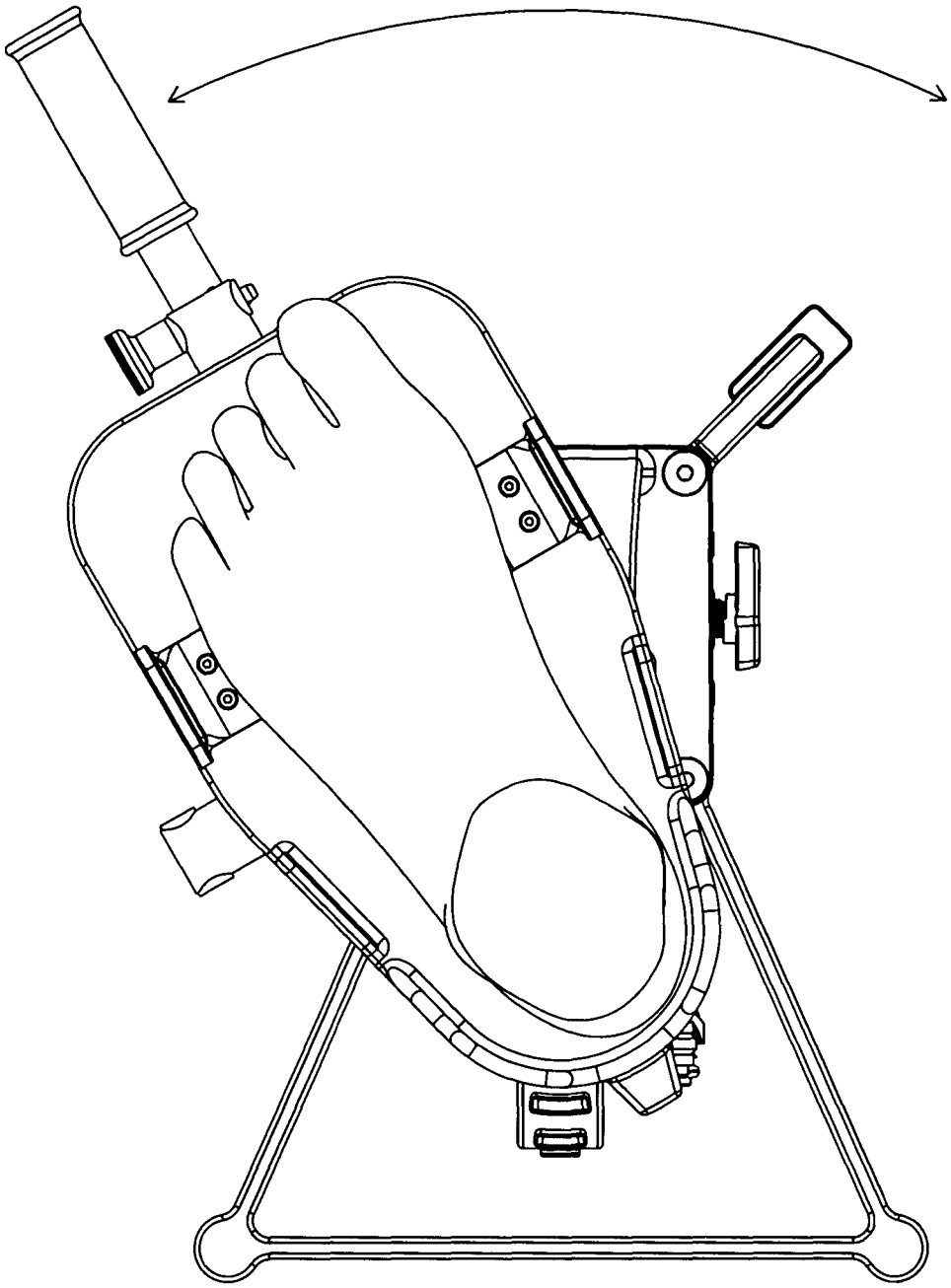
FIG. 14 is a top view of the stretching device of FIG. 1 showing the foot support twisted to the left within a horizontal plane that includes an upper surface of the foot support.
Figure 15:
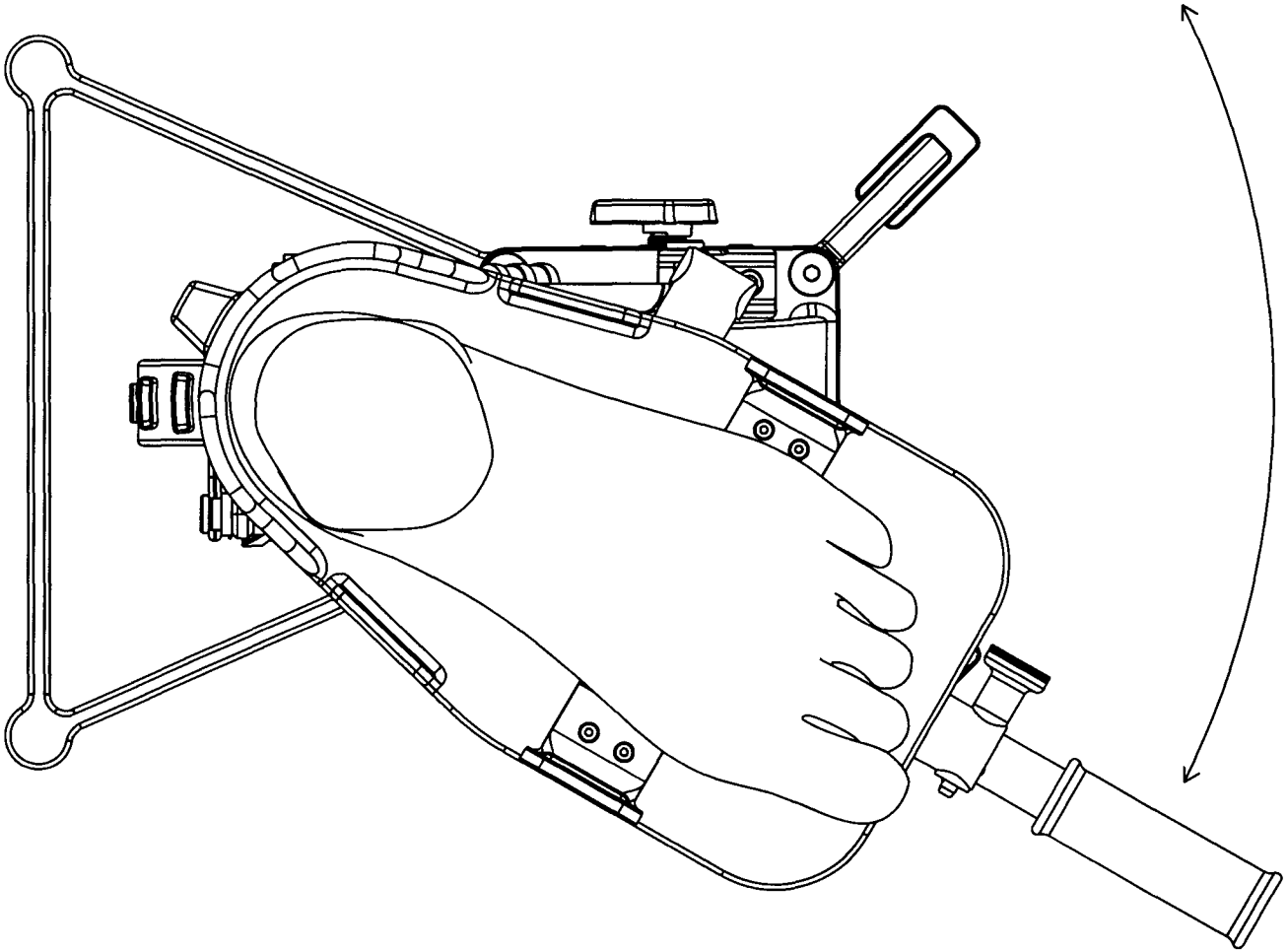
FIG. 15 is a top view of the stretching device of FIG. 1 showing the foot support twisted to the right within the horizontal plane.
Figure 16:
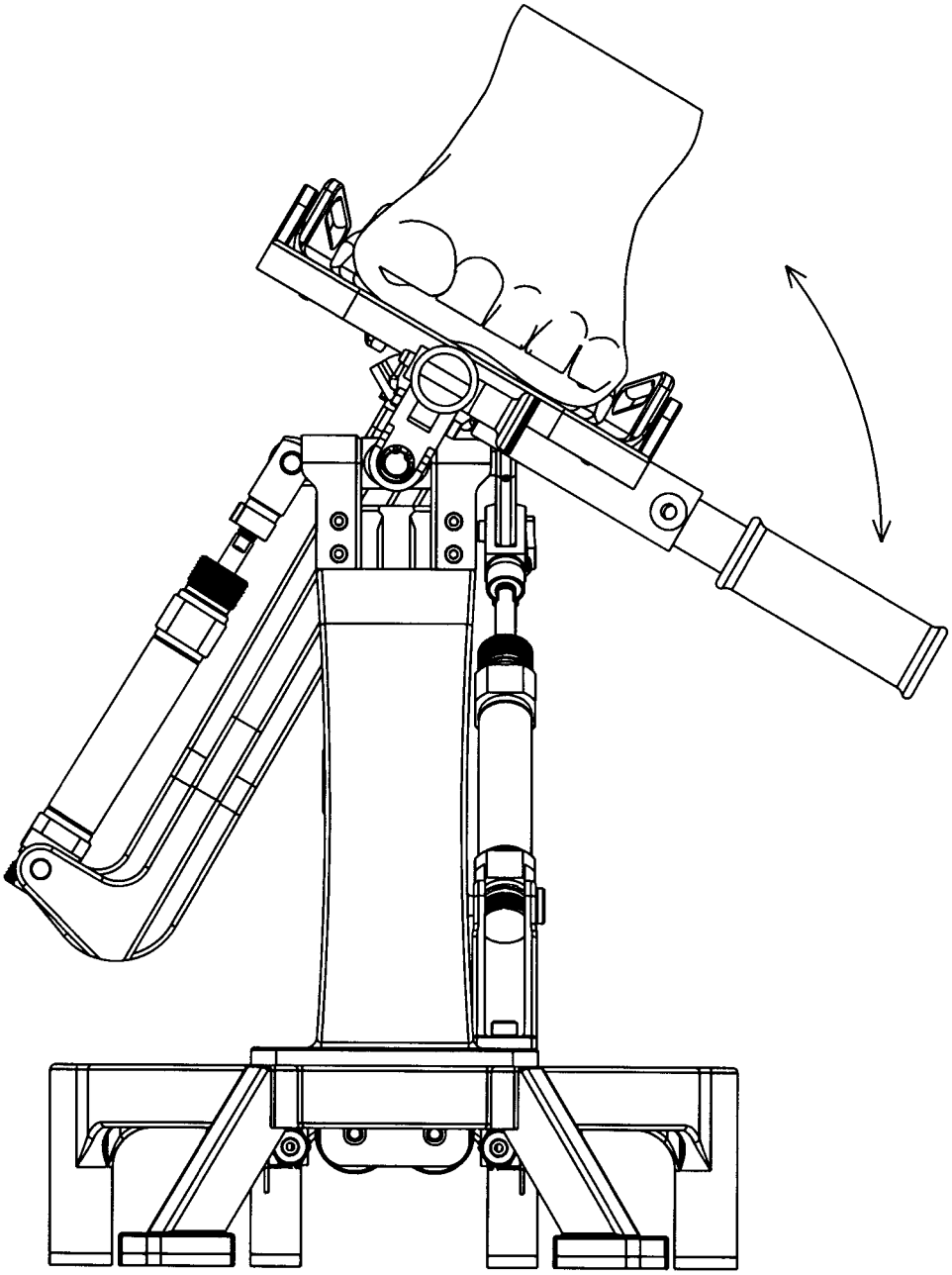
FIG. 16 is a front view of the stretching device of FIG. 1 showing the foot support rolled toward the left.
Figure 17:
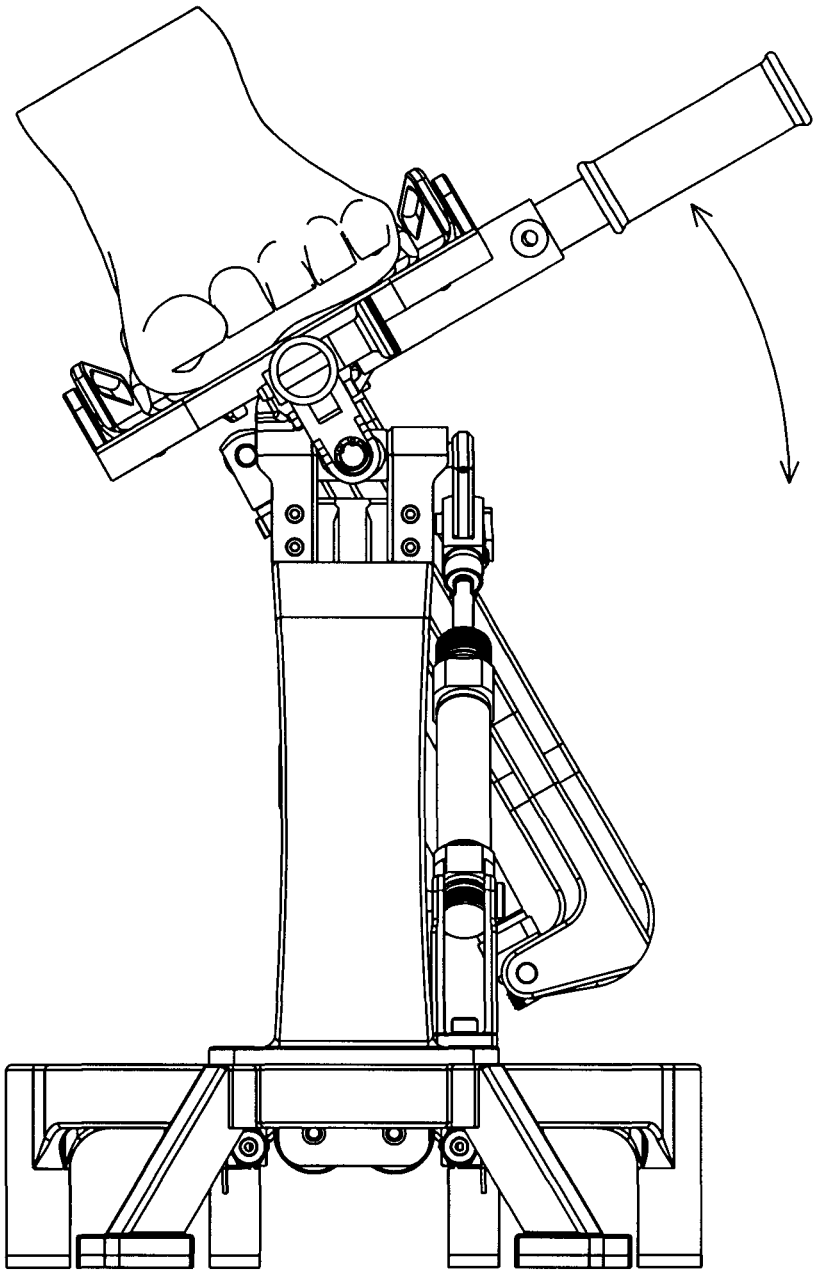
FIG. 17 is a front view of the stretching device of FIG. 1 showing the foot support rolled toward the right.

The foot support 12 may be rotated about the coupling 20 and the three axes A-A, B-B, C-C between a neutral position and a plurality of rotated positions. The foot support 12 in the neutral position is shown in FIG. 1. In the neutral position, the first foot support axis D-D is orthogonal to the first axis A-A and the third axis C-C and is parallel to the second axis B-B and the second axis of rotation E-E is parallel to the third axis C-C and orthogonal to the first axis A-A and the second axis B-B. The rotated positions include a twisting rotated position, a rolling rotated position, and a flexing rotated position. The twisting rotated position is shown in FIGS. 14 and 15 and is when the first foot support axis D-D is rotated about the first axis A-A such that the first foot support axis D-D and the second axis B-B are in parallel planes and an angle between the first foot support axis D-D and the second axis B-B is greater than 0°. The rolling rotated position is shown in FIGS. 16 and 17 and is when the second foot support axis E-E is rotated about the second axis B-B such that the second foot support axis E-E and the third axis C-C are in parallel planes and an angle between the second foot support axis E-E and the third axis C-C is greater than 0°. The flexing rotated position is shown in FIGS. 18 and 19 and is when the first foot support axis D-D is rotated about the third axis C-C such that the first foot support axis D-D and the second axis B-B are in parallel planes and an angle between the first foot support axis D-D and the second axis B-B is greater than 0°.

In particular, FIGS. 14 and 15 illustrate the twisting rotated position of the foot support 12. Movement from the neutral position through this position provides a twisting side-to-side stretch. To limit the angle through which the first foot support axis D-D is able to rotate about the first axis A-A relative to the neutral position, a first rotational stop and a second rotational stop are disposed on one of the base 19 and/or the lower surface 14 of the foot support 12. For example, the first and second rotational stops prevent the first foot support axis D-D from moving more than about 30° away from the neutral position, which is the normal range of motion limit for this type of stretching activity.

Figure 22:
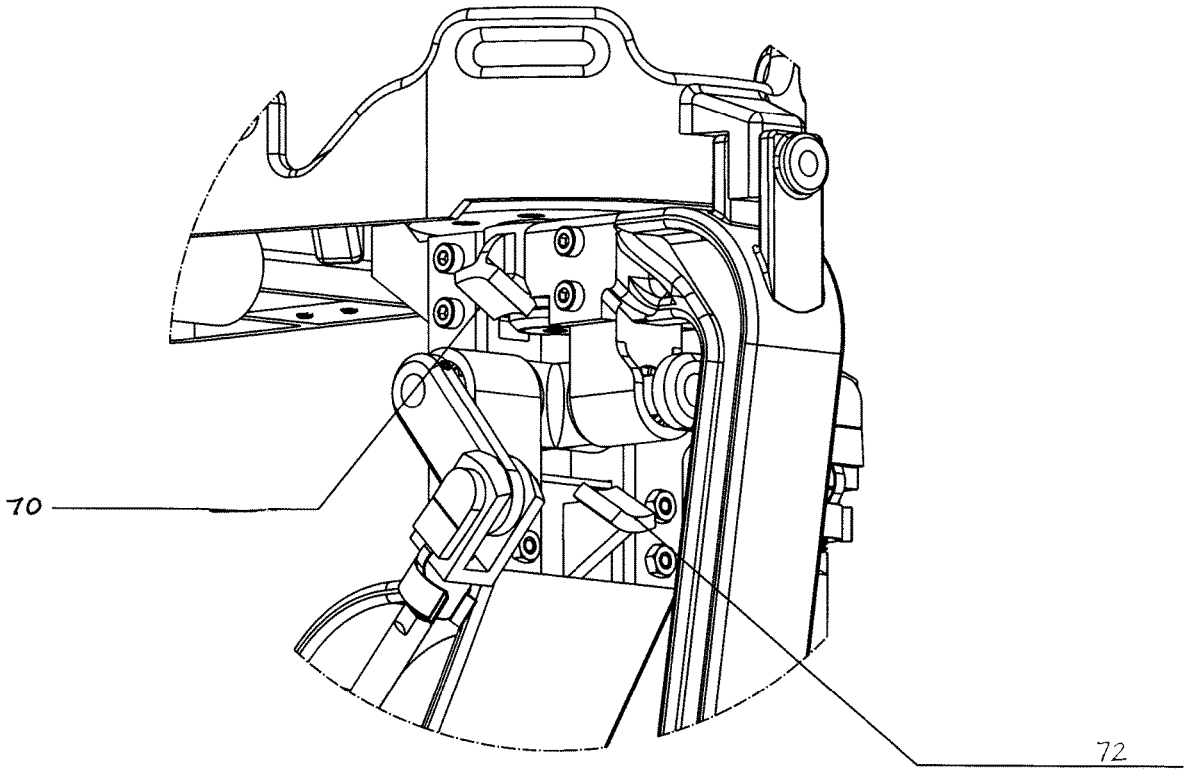
FIG. 22 is a partial rear perspective view of the stretching device in FIG. 1 showing a stop for limiting the rolling movement of the foot support toward the right side and a stop for limiting upward movement of the distal end of the foot support.
Figure 23:
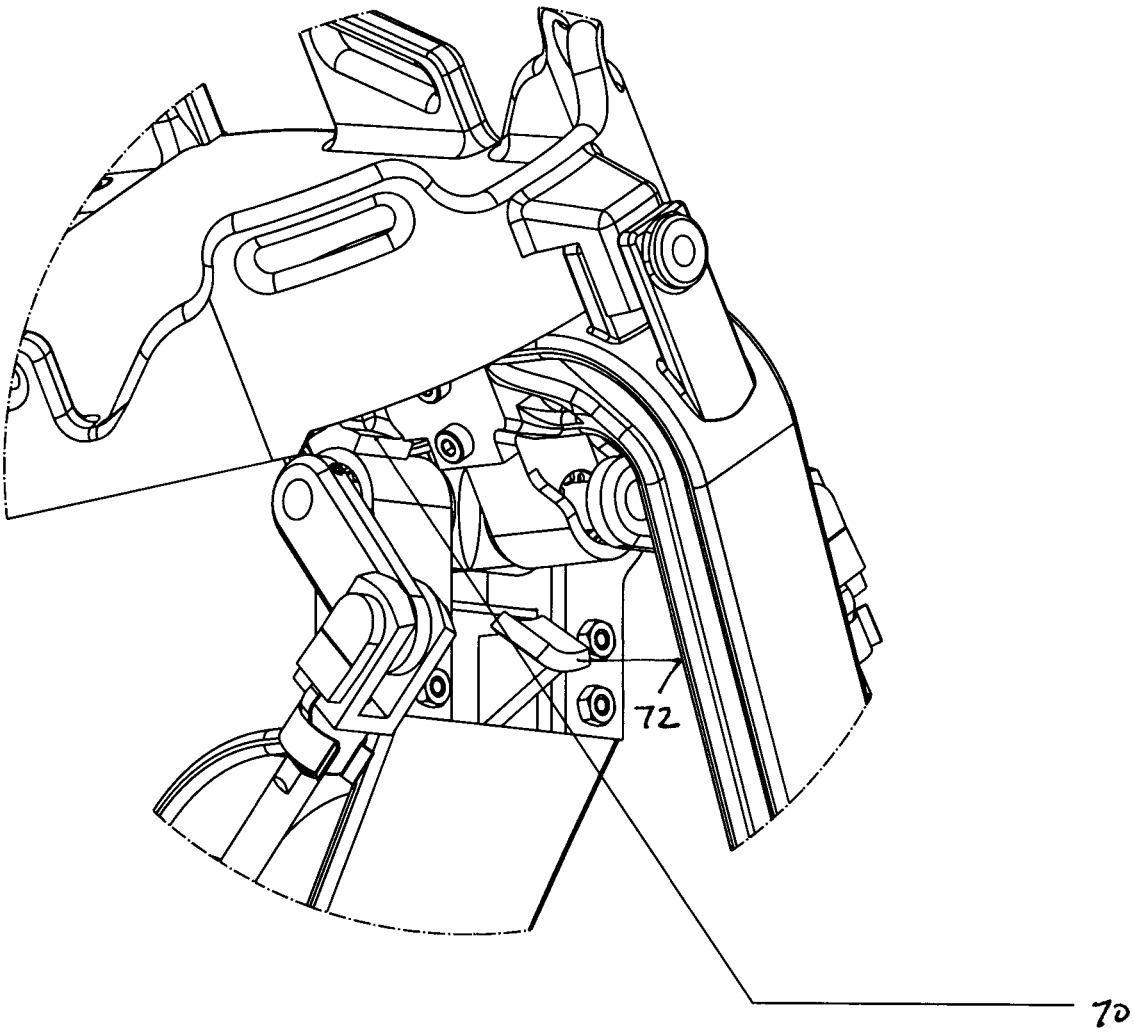
FIG. 23 is a partial rear perspective view of the stop shown in FIG. 22 for limiting the rolling movement of the foot support toward the right side when the stop is engaged against the coupling.
Figure 24:
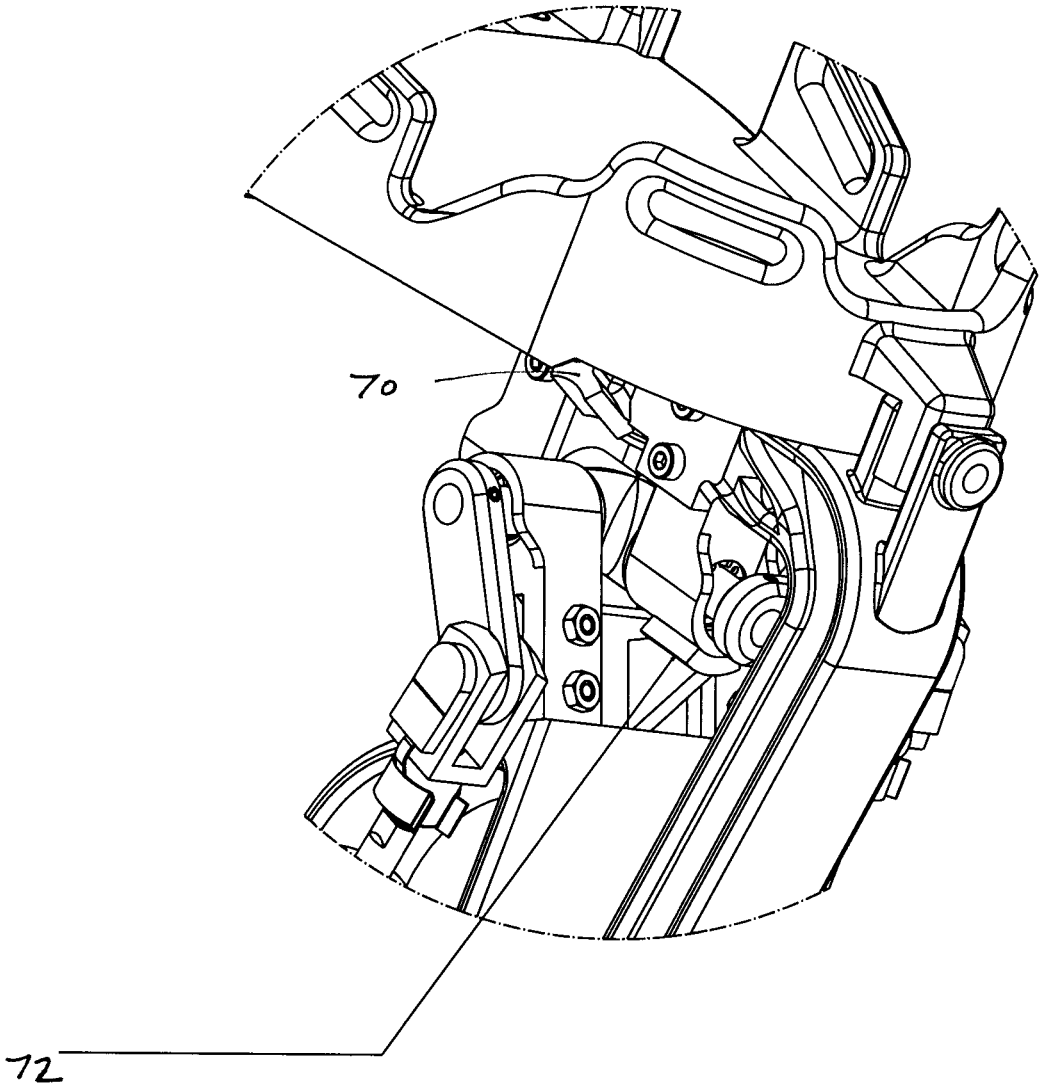
FIG. 24 is a partial rear perspective view of the stop shown in FIG. 22 for limiting the upward movement of the distal end of the foot support when the stop is engaged against the coupling

FIGS. 16 and 17 illustrate the rolling rotated position of the foot support 12. Movement from the neutral position through the rolling rotated position provides a rolling (or rocking) stretch by allowing each side of the foot to twist downwardly while the opposite side of the foot twists upwardly. To limit the angle through which the second foot support axis E-E is able to rotate about the second axis B-B relative to the neutral position, a third rotational stop 70 and a fourth rotational stop (not shown) are disposed adjacent the lower surface 14 of the foot support 12, which are shown in FIGS. 22-24. For example, the third 70 and fourth rotational stops prevent the second foot support axis E-E from moving more than about 30° away from the neutral position, which is the normal range of motion limit for this type of stretching activity.

Figure 18:
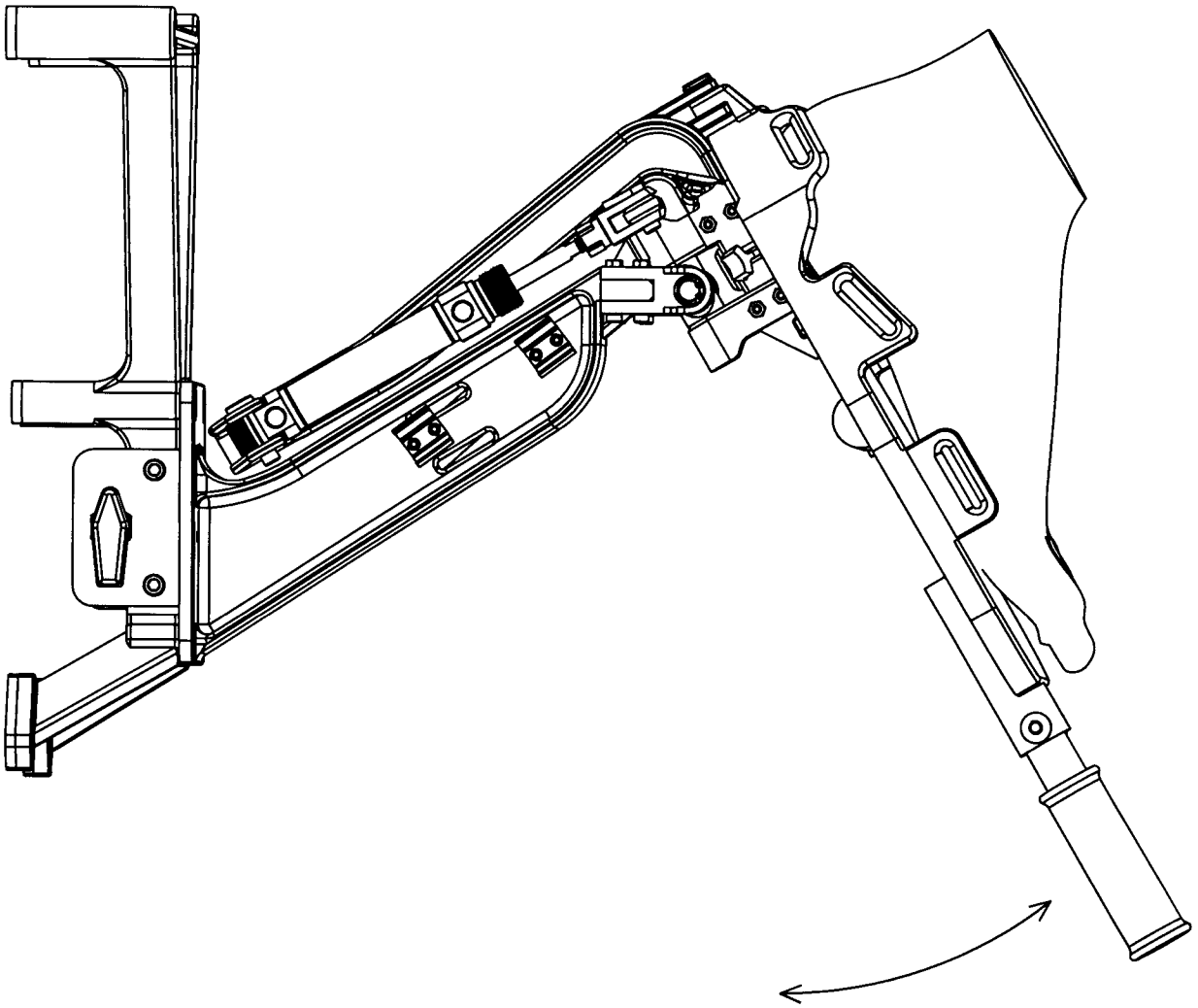
FIG. 18 is a side view of the stretching device of FIG. 1 showing the distal end of the foot support raised upwardly relative to the proximal end of the foot support.
Figure 19:
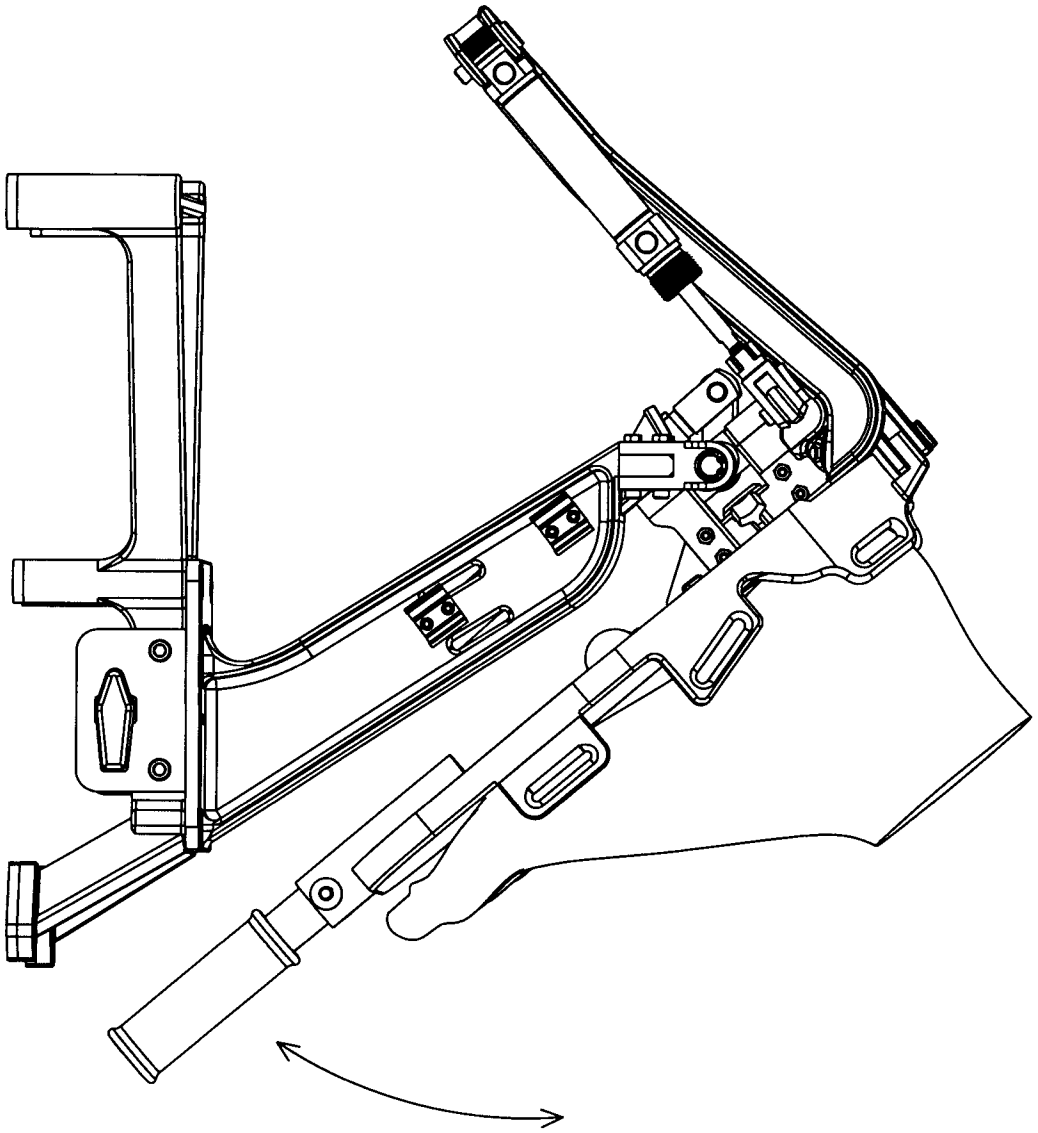
FIG. 19 is a side view of the stretching device of FIG. 1 showing the distal end of the foot support lowered downwardly relative to the proximal end of the foot support.

FIGS. 18 and 19 illustrate the distal end 16 of the foot support 12 moving up and down, respectively, about the third axis C-C, to achieve a dorsiflexion and plantar flexion stretch, respectively. As noted above, for this flexing motion, the first foot support axis D-D rotates relative to the second axis B-B about the third axis C-C. To limit the angle through which the first foot support axis D-D is able to rotate about the third axis C-C relative to the second axis B-B, a fifth rotational stop 72 and a sixth rotational stop (not shown) are disposed adjacent the base 19 to limit the angle through which the first foot support axis D-D may rotate relative to the second axis B-B about the third axis C-C, which are shown in FIGS. 22-24. For example, the fifth 72 and sixth rotational stops prevent the first foot support axis D-D from moving more than 30° in an upward, or dorsiflexion, direction from the second axis B-B or more than about 50° in a downward, or plantar flexion, direction from the second axis B-B.

Other implementations (not shown) may include other types of rotational stops for preventing rotation of the foot support 12 outside of the normal ranges of motion for these stretches.

Figure 3:
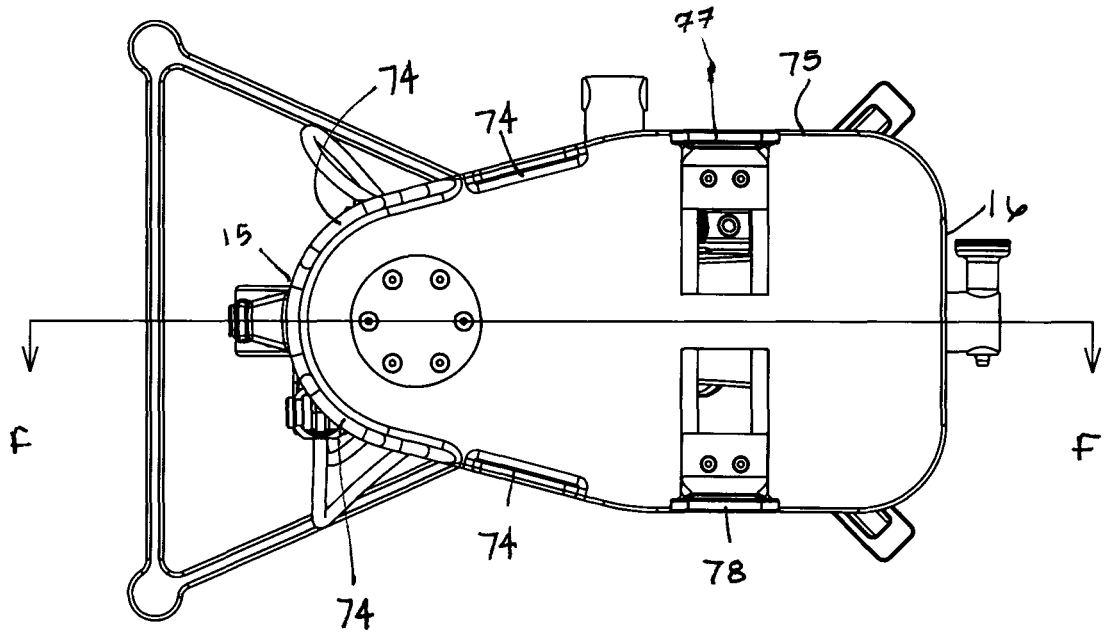
FIG. 3 is a top view of the stretching device in FIG. 1 with side strap supports in the widest position.
Figure 4:
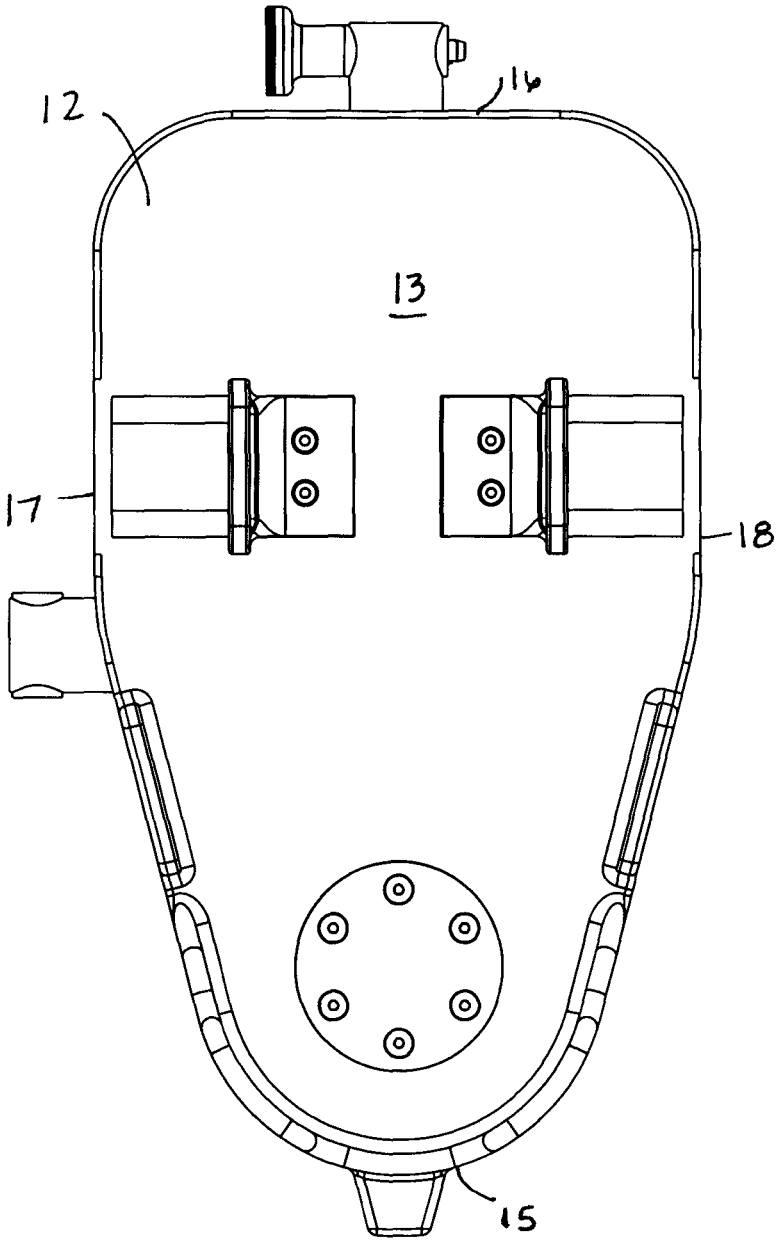
FIG. 4 is a top view of the stretching device in FIG. 1 with the side strap supports in the narrowest position.
Figure 13:
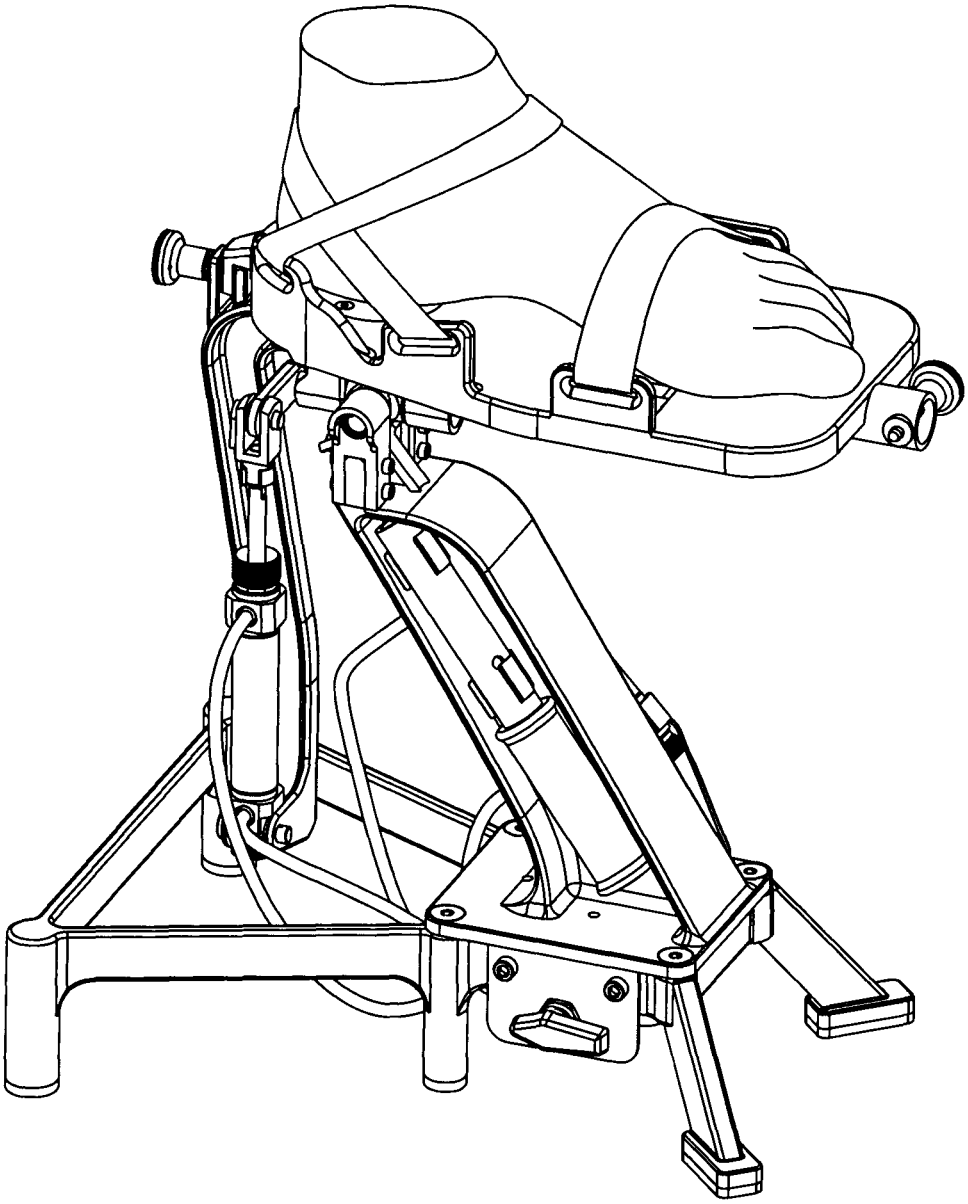
FIG. 13 is a front perspective view of the stretching device of FIG. 1 showing the foot support with straps to secure a patient's foot to the foot support.

As shown in FIGS. 3, 4, and 13, the foot support 12 includes a plurality of strap supports 74 adjacent the proximal end 15 and a middle region 75 of the foot support 12. The middle region 75 extends between the proximal end 15 and the distal end 16. The strap supports 74 extend upwardly from the upper surface 13 of the foot support 12 and define openings through which one or more straps are thread. The straps wrap around portions of a patient's foot disposed on the upper surface 13 of the foot support 12 to secure the foot onto the foot support 12. The strap supports 74 adjacent the middle region 75 include a medial strap support 77 and a lateral strap support 78. The medial strap support 77 and the lateral strap support 78 are slidably coupled to the upper surface 13 of the foot support 12, and the width between the supports 77, 78 is adjustable by sliding the supports 77, 78 toward or away from each other. The slidable strap supports 77, 78 allow for the stretching device 10 to secure feet having various widths onto the foot support 12. Although the medial strap support 77 is shown on the left side of the foot support 12 and the lateral strap support 78 is shown on the right side of the foot support 12, the strap supports 77, 78 may be reversed depending on what foot is on the foot support 12.

The straps may have hook and loop closures, buckles, or other suitable securing mechanisms.

Figure 5:
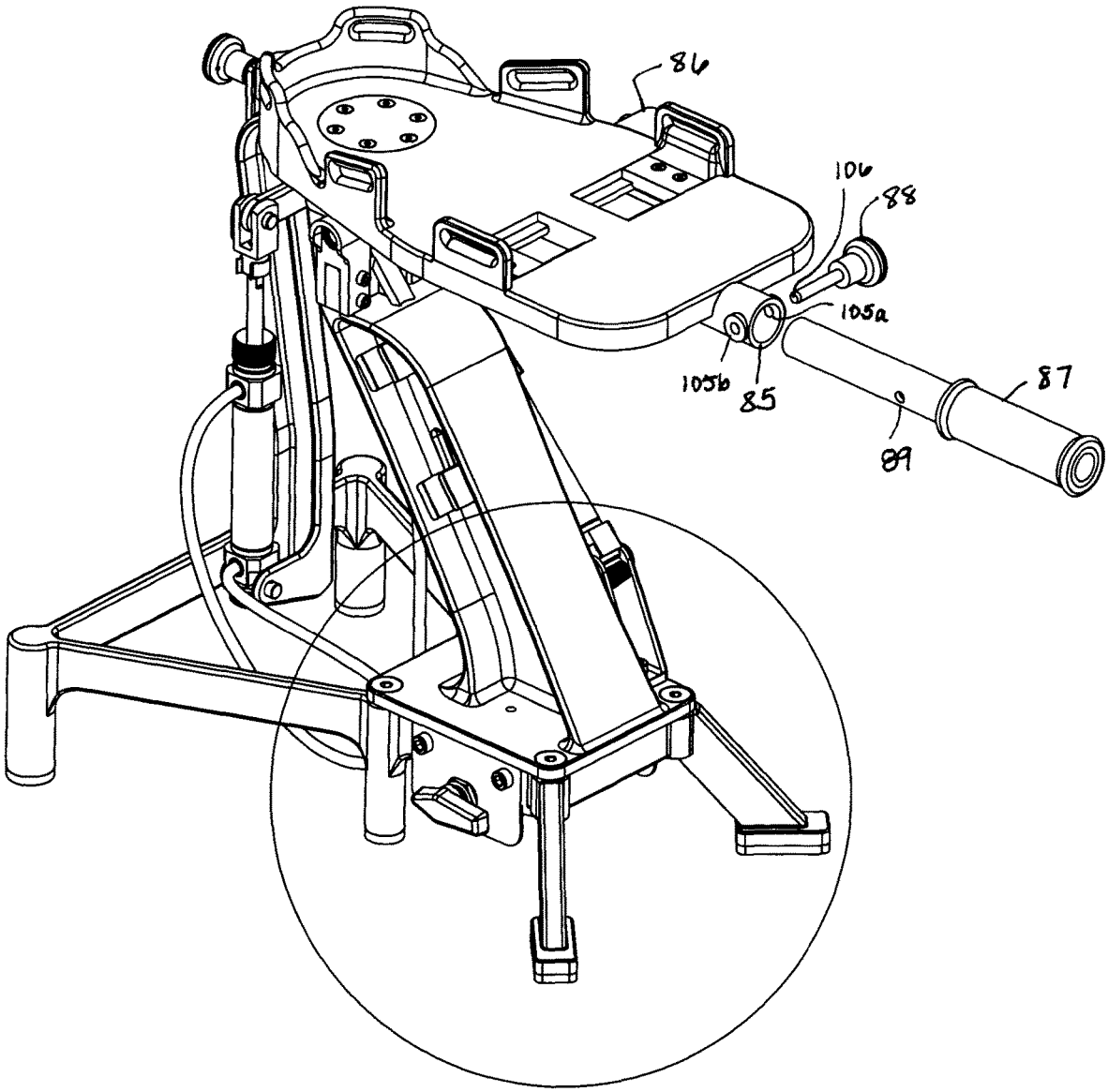
FIG. 5 is a front perspective view of the stretching device in FIG. 1 having a handle uncoupled from the stretching device.
Figure 6:
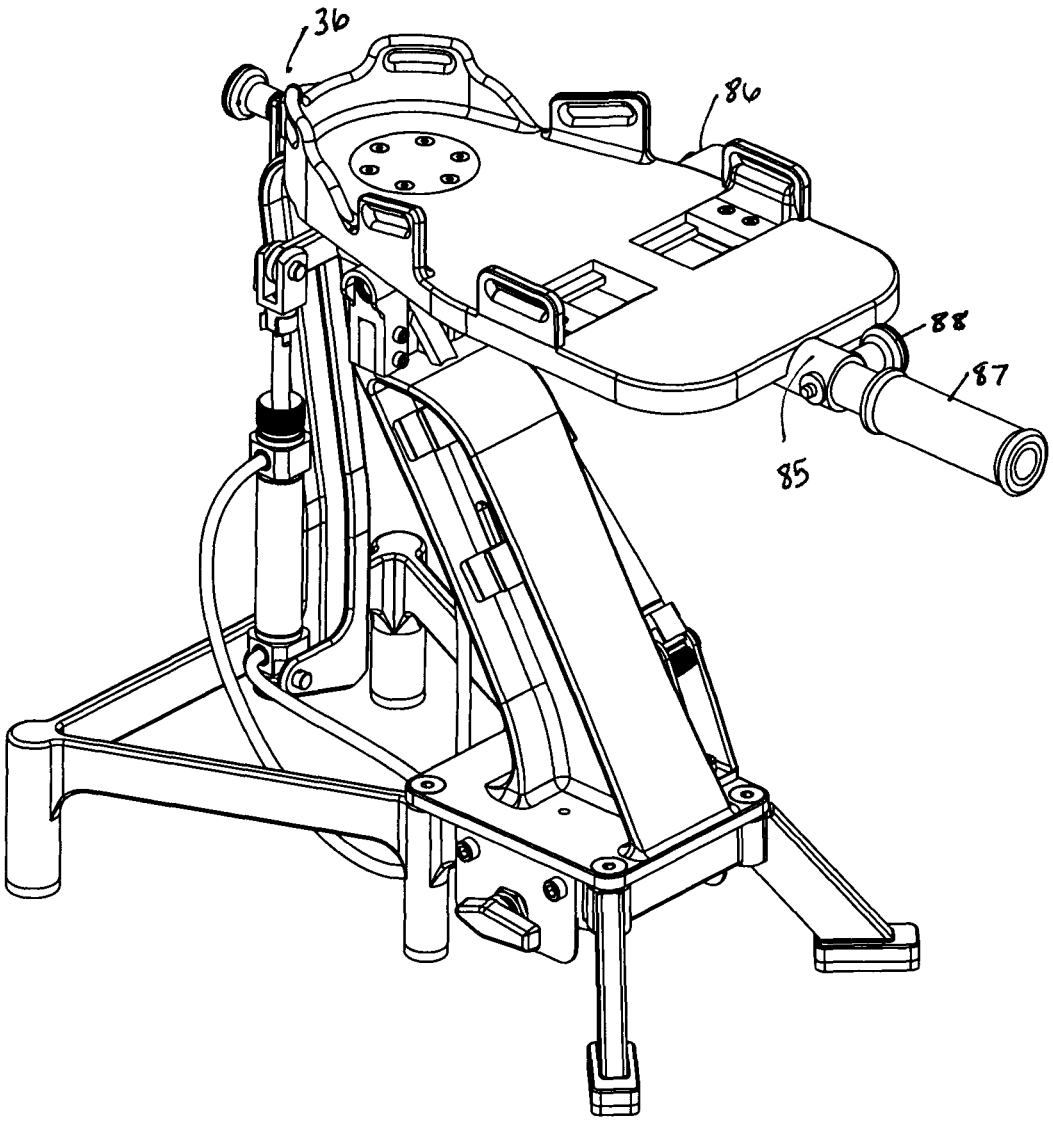
FIG. 6 is a front perspective view of the stretching device in FIG. 1 having the handle coupled to a distal end of a foot support of the stretching device.
Figure 7:
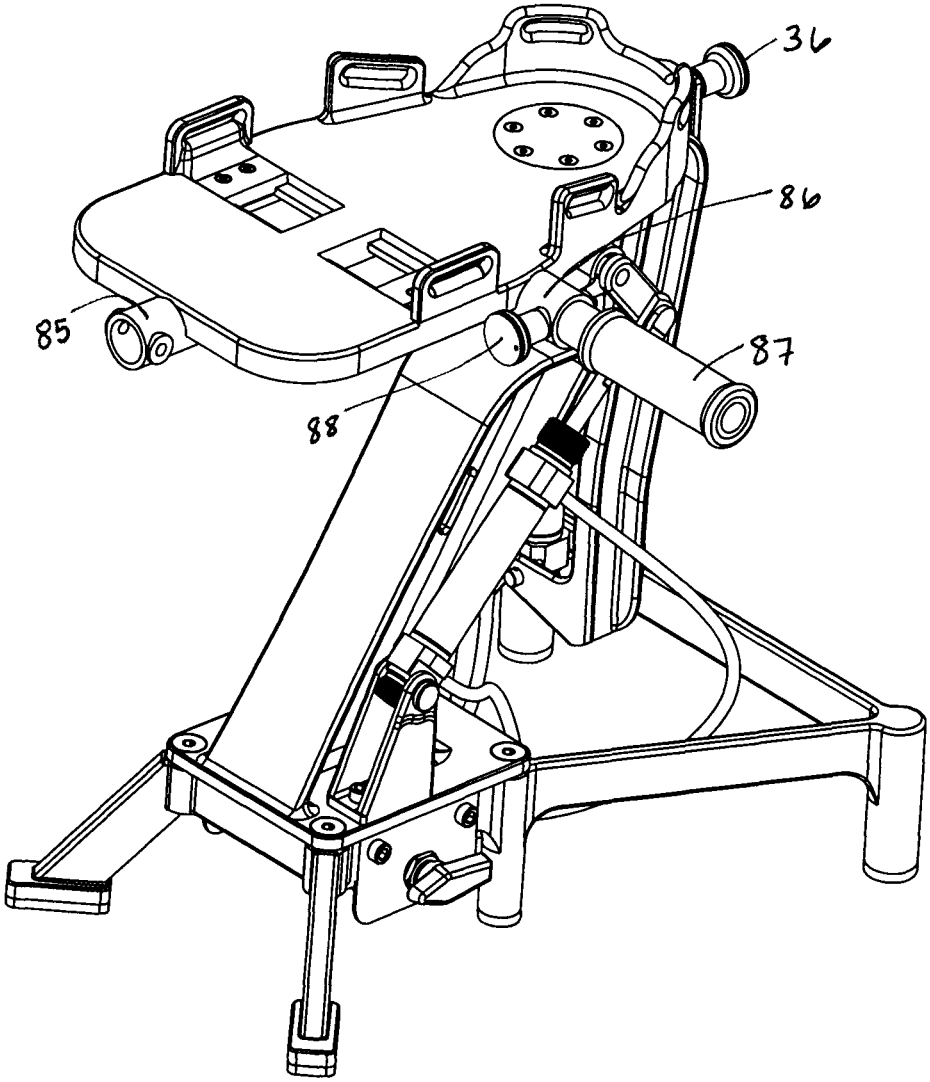
FIG. 7 is a front perspective view of the stretching device in FIG. 1 having the handle coupled to a side of the foot support.

FIGS. 5, 6, and 7 illustrate a handle 87 for coupling to the foot support 12. The handle 87 assists the caregiver in manipulating the foot support 12 through the various ranges of motion. For example, the caregiver may couple the handle 87 to the distal end 16 of the foot support to assist with the upward/downward flexing stretch about the third axis C-C and the side-to-side rotational movement of the foot support 12 about the first axis A-A, which is shown in FIG. 6. And, the caregiver may couple the handle 87 to one of the first side 17 or second side 18 of the foot support 12 to assist with the rolling stretch about the second axis B-B, which is shown in FIG. 7.

As shown in FIGS. 5, 6, and 7, the handle 87 is removably coupled to the foot support 12 by engaging one end of the handle 87 into a distal boss 85 adjacent the distal end 16 of the foot support 12 or a side boss 86 adjacent one of the first side 17 or second side 18 of the foot support 12. The bosses 85, 86 define a central opening through with the end of the handle 87 extends. To secure the handle 87 into the boss 85, 86, two side openings 89 on each side of the handle 87 are aligned with two side openings 105*a*, 105*b* defined in each boss 85, 86, and a distal end 106 of a pin 88 is extended through the side openings 89, 105*a*, 105*b*.

As shown in FIGS. 1, 2, 20, and 21, the base 19 includes a lower support 90 for engaging a support surface, such as the floor, table, or stool, and a main arm 93 that extends between the lower support 90 and the coupling 20. In addition, the base 19 may include includes an L-shaped swing arm 99. The swing arm 99 has a first portion 101 that is disposed between the coupling 20 and the lower surface 14 of the foot support 12 and a second portion 100 that extends between the first portion 101 and a free end 102. The free end 102 of the swing arm 99 is configured for swinging right or left in response to rotating the foot support 12 about the second axis B-B or backward or forward in response to rotating the foot support about the third axis C-C.

As shown in FIGS. 20 and 21, the first portion 101 of the swing arm 99 defines an opening 110 that is part of coupling 20. A boss 112 extending from the lower surface 14 of the foot support 12 extends through the opening 110 defined by the first portion 101 of the swing arm 99. A protrusion 114 extends from the center portion 22 of universal joint 21 and into an opening of the boss 112. A bearing 27 is disposed between an outer surface of the boss 112 and the opening 110 of the first portion 101 of the swing arm 99. A second bearing (not shown) may also be disposed between the protrusion 114 and the inner surface of the boss 112.

The device 10 also includes locks for preventing rotation of the foot support 12 about one of the three axes A-A, B-B, C-C. In addition, as shown in FIGS. 6, 7, and 20-22, the device 10 includes a lock for preventing rotation about the first axis A-A. The lock includes a removable pin 36, an opening 38 defined by the swing arm 99, and an opening 39 adjacent the proximal end 15 of the foot support 12. The pin 36 is removably engaged into the openings 38, 39 defined by the swing arm 99 and the proximal end 15 of the foot support 12 to prevent rotation about the first axis A-A, and the pin 36 is removed from the openings 38, 39 to allow for rotation about the first axis A-A.

FIGS. 1, 2, 8-12, and 25-26 illustrate a second lock for preventing rotation of the foot support 12 about the second axis B-B and a third lock for preventing rotation about the third axis C-C. The second lock includes a closed loop pneumatic system 40, and the third lock includes a closed loop pneumatic system 53.

Figure 25:
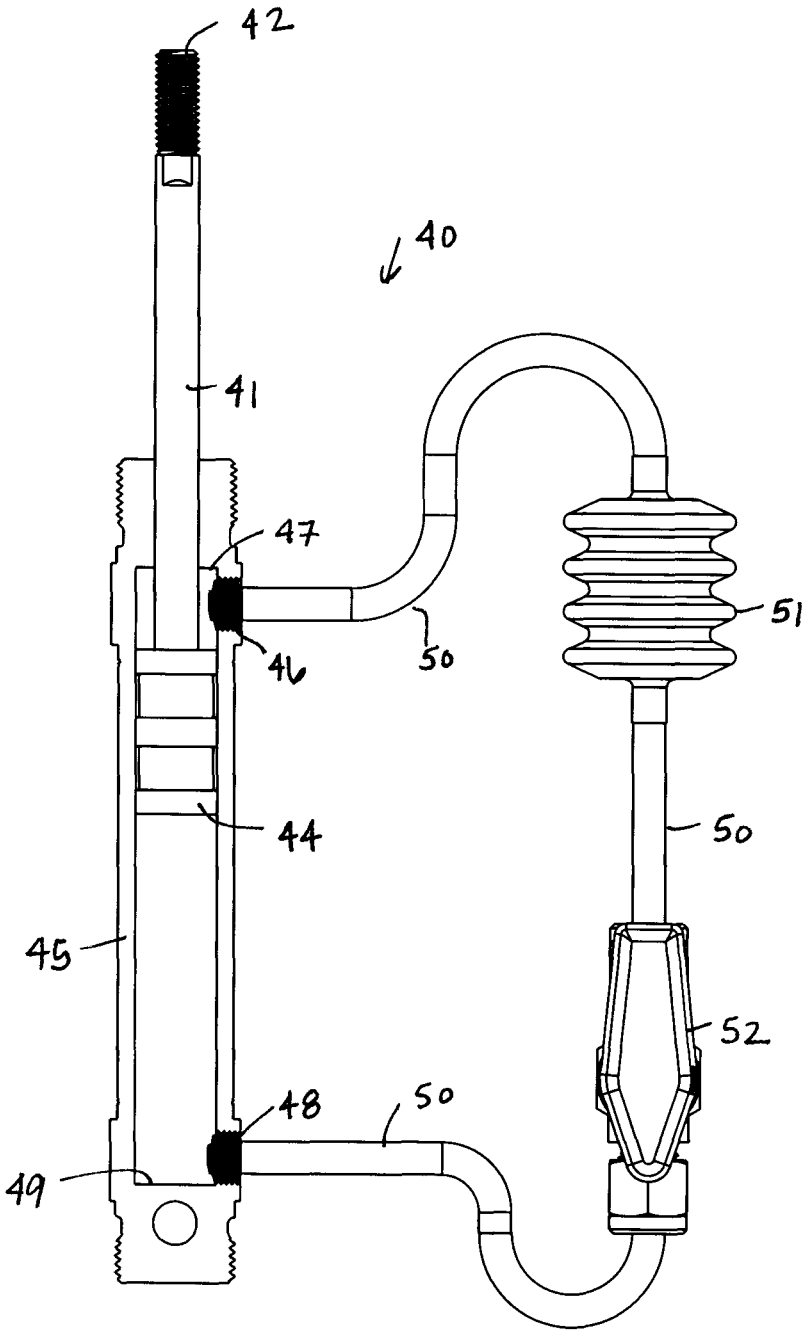
FIG. 25 is a top view of the pneumatic cylinder system shown in FIG. 1 with the expansion bladder in the collapsed position.

As shown in FIG. 25, closed loop pneumatic system 40 includes a rod 41 having a distal end 42 coupled to the second axis B-B of the coupling 20 (e.g., the proximal arm 23 or the distal arm 24 of the universal joint 21) via a linkage 43 and a proximal end 44 moveable within a pneumatic cylinder 45. The pneumatic cylinder 45 defines a first port 46 adjacent a distal end 47 of the cylinder 45 and a second port 48 adjacent a proximal end 49 of the cylinder 45. The pneumatic system 40 also includes conduits 50 in fluid communication between the first 46 and second ports 48 and each end of an expansion bladder 51 and in fluid communication with a valve 52. Movement of the proximal end 44 of the rod 41 toward the proximal end 49 of the cylinder 45 causes gas in the system 40 to expand the bladder 51. This expansion bladder 51 receives the gas displaced by the proximal end 44 of the rod 41 and expands when the volume of gas displaced through the second port 48 exceeds the available volume in the cylinder 45 between the proximal end 44 of the rod 41 and the distal end 47 of the cylinder 45. When the valve 52 is in the closed position and no gas is allowed to flow through the system 40, the pneumatic system 40 prevents movement of the foot support 12 about the second axis B-B. When the valve 52 is opened, the foot support 12 may be rotated about the second axis B-B, and the pneumatic system 40 provides resistance to this movement to help control the speed with which the therapist or caregiver rotates the foot support 12.

The cylinder 45 is coupled to the second portion 100 of the swing arm 99, and the expansion bladder 51 and valve 52 are disposed adjacent the lower support 90 of the base 19.

Figure 26:
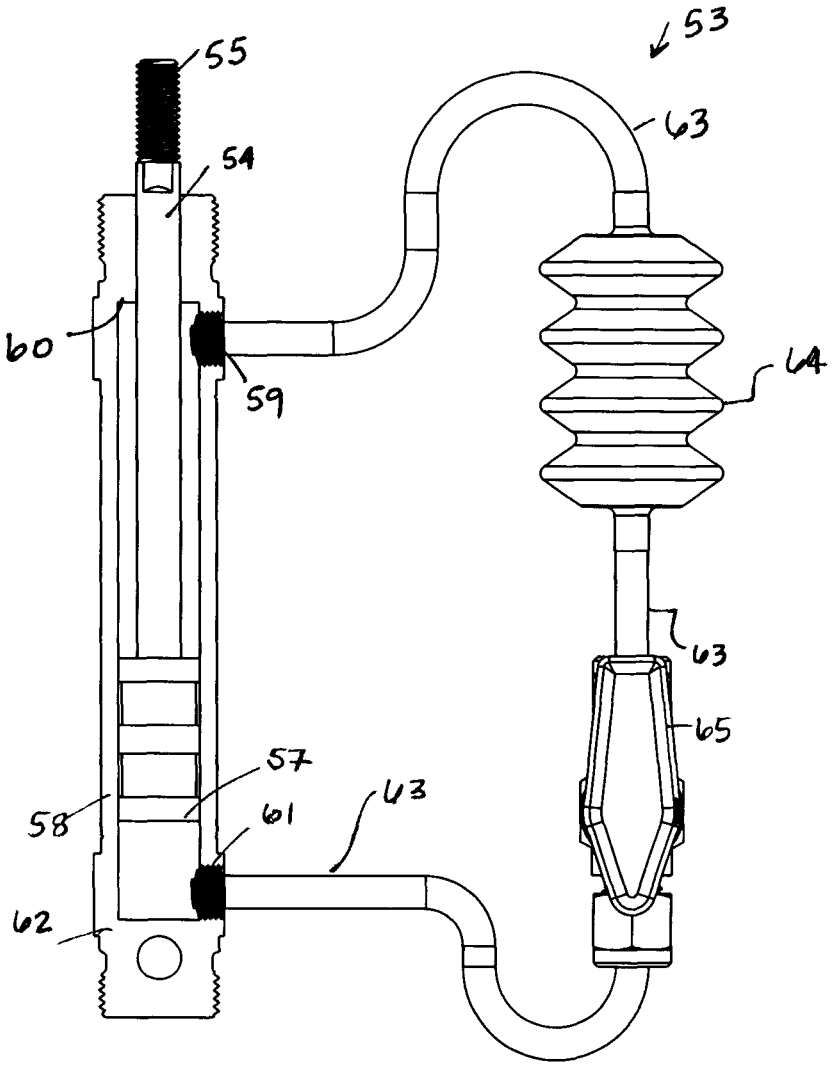
FIG. 26 is a top view of the pneumatic cylinder system shown in FIG. 1 with the expansion bladder in the expanded position.

As shown in FIG. 26, closed loop pneumatic system 53 includes a rod 54 having a distal end 55 coupled to the third axis C-C (e.g., the first side arm 25 or the second side arm 26 of the universal joint 21) of the coupling 20 via a linkage 56 and a proximal end 57 moveable within a pneumatic cylinder 58. The pneumatic cylinder 58 defines a first port 59 adjacent a distal end 60 of the cylinder 58 and a second port 61 adjacent a proximal end 62 of the cylinder 58. The pneumatic system 53 also includes conduits 63 in fluid communication between the first 59 and second ports 61 and each end of an expansion bladder 64 and in fluid communication with a valve 65. Movement of the proximal end 57 of the rod 54 toward the proximal end 62 of the cylinder 58 causes gas in the system 53 to expand the bladder 64. This expansion bladder 64 receives the gas displaced by the proximal end 57 of the rod 54 and expands when the volume of gas displaced through the second port 61 exceeds the available volume in the cylinder 58 between the proximal end 57 of the rod 54 and the distal end 60 of the cylinder 58. When the valve 65 is in the closed position and no gas is allowed to flow through the system 53, the pneumatic system 53 prevents movement of the foot support 12 about the third axis C-C. When the valve 65 is opened, the foot support 12 may be rotated about the third axis C-C, and the pneumatic system 53 provides resistance to this movement to help control the speed with which the therapist or caregiver rotates the foot support 12.

The proximal end 62 of the cylinder 58 is coupled to the lower support 90 of the base 19, and the expansion bladder 64 and valve 65 are disposed adjacent the lower support portion 90 of the base 19.

Figure 8:
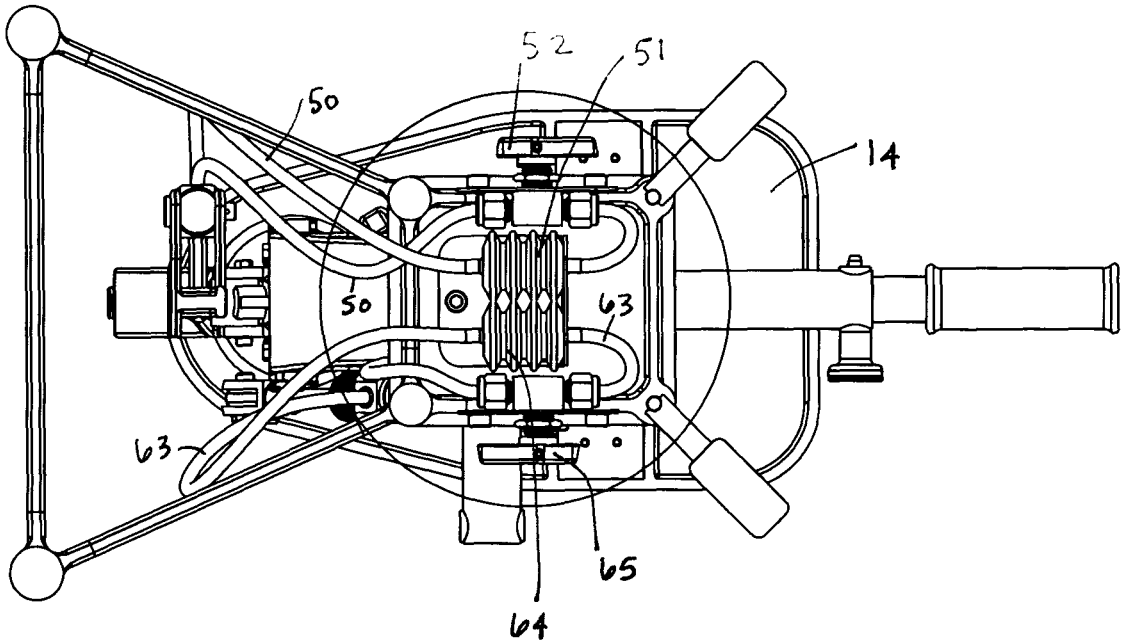
FIG. 8 is a bottom view of the stretching device of FIG. 1.
Figure 9:
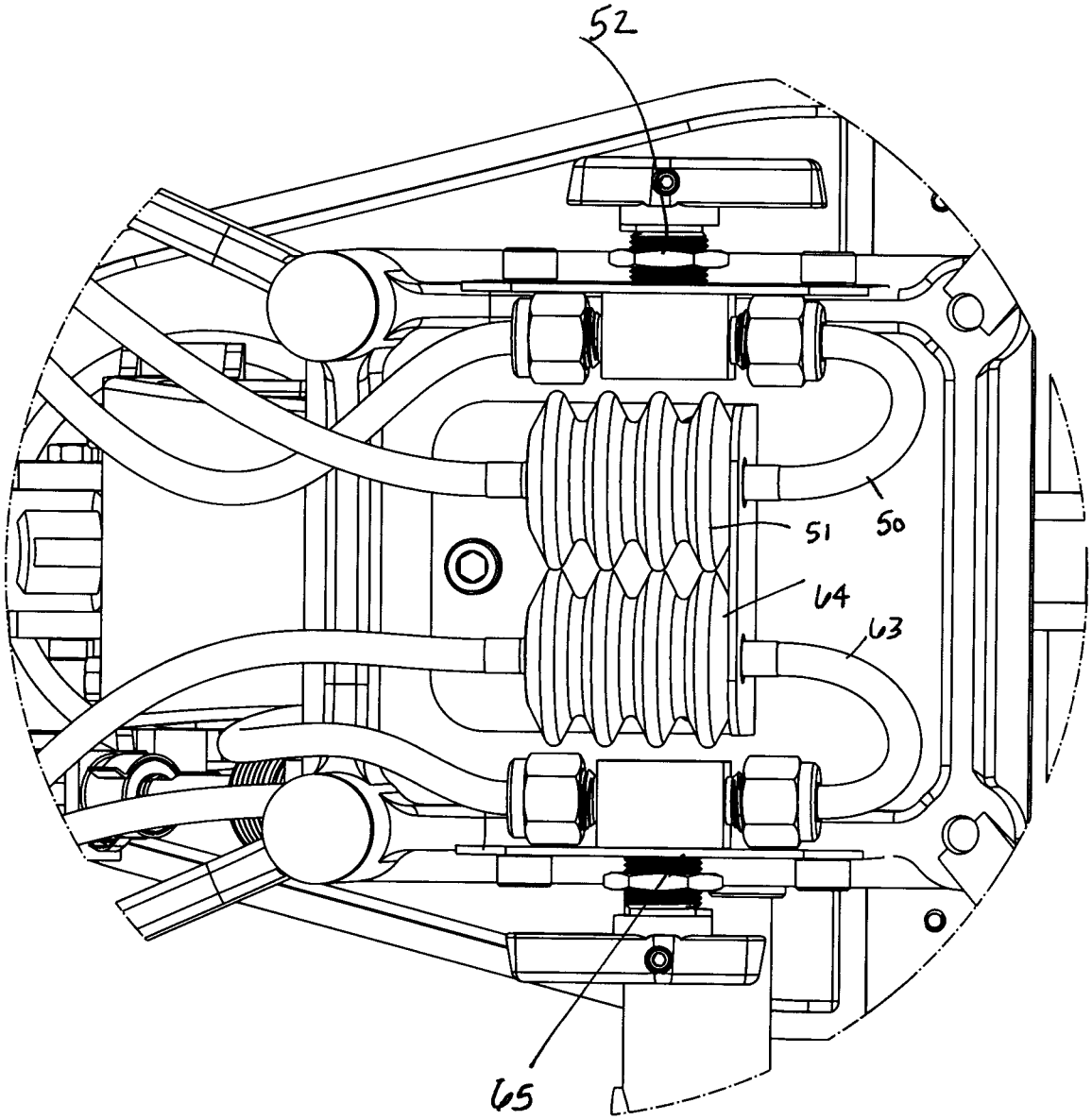
FIG. 9 is a partial bottom view of the stretching device of FIG. 1 showing expansion bladders that are part of each pneumatic system. The expansion bladders are in their collapsed positions.
Figure 10:
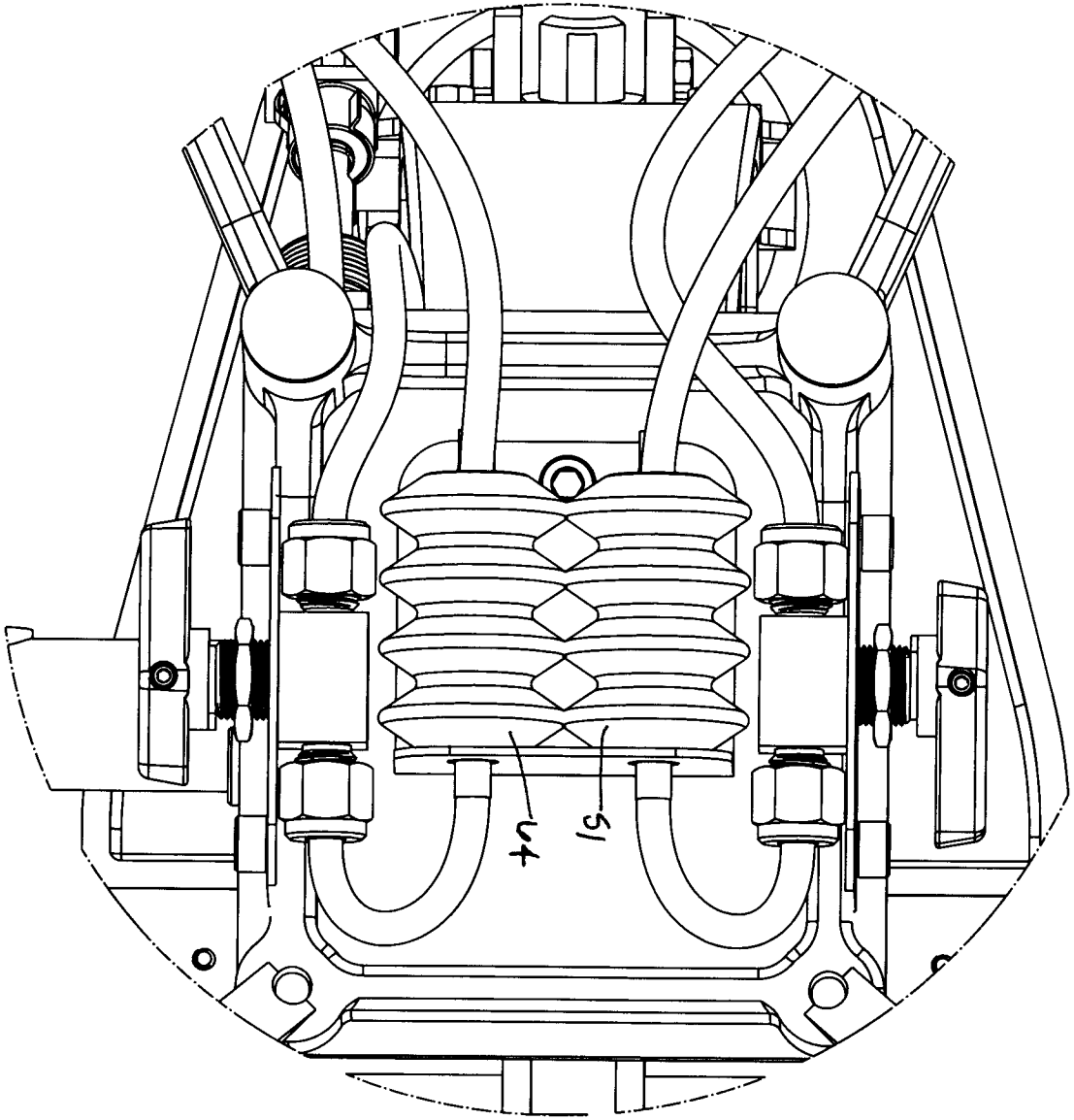
FIG. 10 is a partial bottom view of the stretching device of FIG. 1 showing the expansion bladders in their expanded positions.
Figure 11:
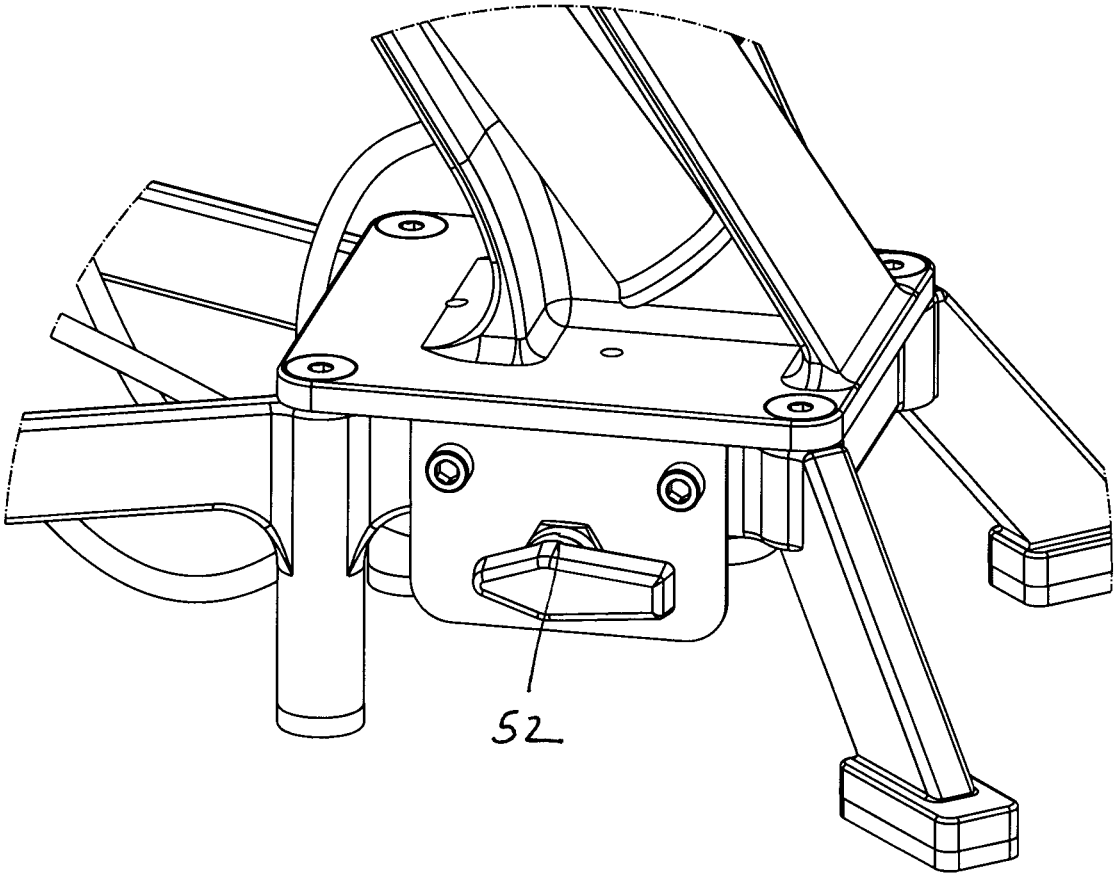
FIG. 11 is a partial side perspective view of the stretching device of FIG. 1 showing a valve to a pneumatic system in the open position.
Figure 12:
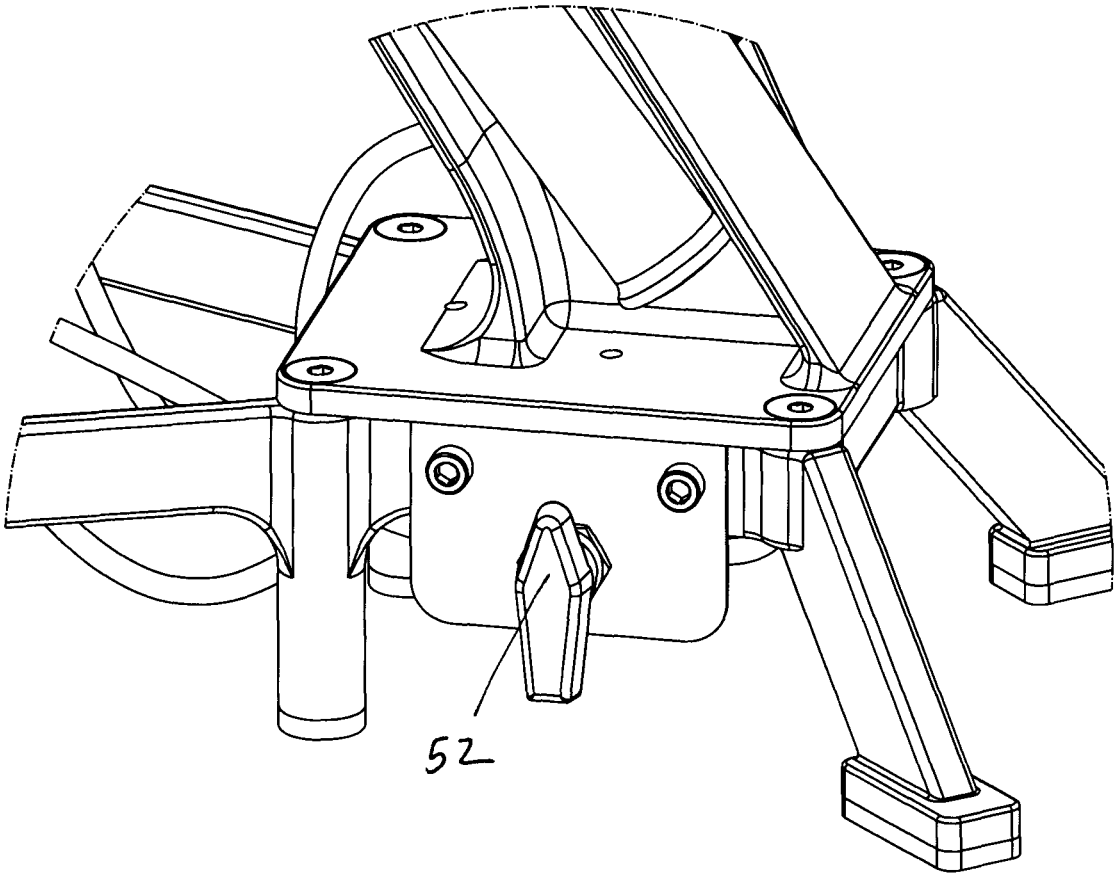
FIG. 12 is a partial side perspective view of the stretching device of FIG. 1 showing the valve to a pneumatic system in the closed position.

FIG. 8 shows the two expansion bladders 51, 64 and conduits 50, 63 extending between the bladders 51, 64 and the pneumatic cylinders 45, 58. FIG. 9 shows the bladders 51, 64 in the collapsed position, and FIG. 10 shows the bladders 51, 64 in the expanded position. FIG. 11 shows the valve 52 in the open position, and FIG. 12 shows the valve 52 in the closed position. Valve 65 is disposed on the other side of the lower support portion 90 of the base 19.

The materials used to form the foot support 12 and the base may include metal (e.g., aluminum), plastic, another suitable material, or a combination thereof.

Figure 27:
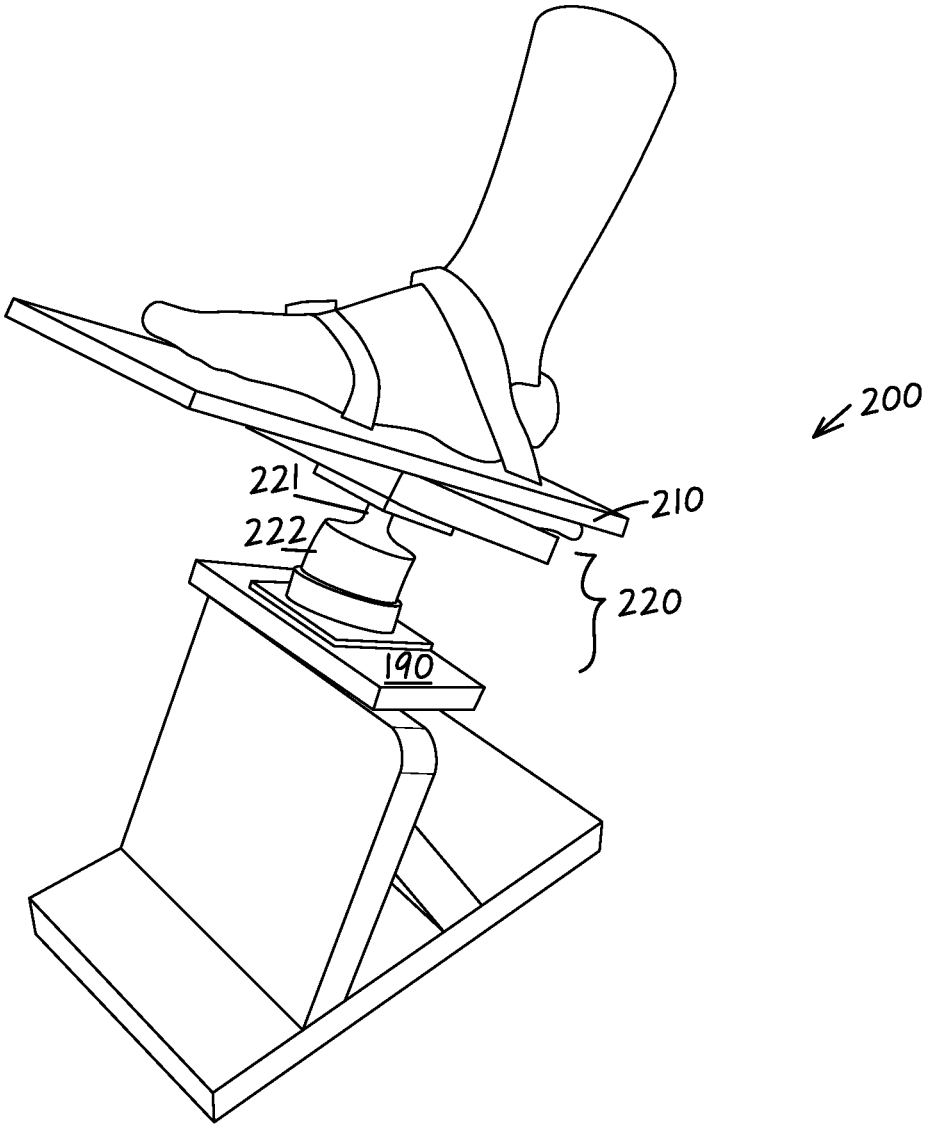
FIG. 27 is a perspective view of a coupling according to another implementation.

FIG. 27 illustrates a device 200 according to another implementation. In this implementation, the coupling 220 includes a ball and socket joint. The socket portion 221 of the ball and socket joint is coupled to one of the base 190 or the foot support 210, and the ball portion 222 of the ball and socket joint is coupled to the other of the foot support 210 or the base 190. The ball and socket joint allows the foot support 210 to rotate relative to the base 190 along the first, second, and third axes described above in relation to coupling 20.

It will be apparent to those skilled in the art that various modifications and variations can be made without departing from the scope or spirit. Other embodiments will be apparent to those skilled in the art from consideration of the specification and practice disclosed herein. It is intended that the specification and examples be considered as exemplary only, with a true scope and spirit being indicated by the following claims.

Furthermore, it is to be understood that the methods and systems are not limited to specific methods or specific components. It is also to be understood that the terminology used herein is for the purpose of describing particular embodiments only and is not intended to be limiting.

As used in the specification and the appended claims, the singular forms "a," "an" and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by use of the antecedent "about," it will be understood that the particular value forms another embodiment. It will be further understood that the endpoints of each of the ranges are significant both in relation to the other endpoint, and independently of the other endpoint.

Throughout the description and claims of this specification, the word "comprise" and variations of the word, such as "comprising" and "comprises," means "including but not limited to," and is not intended to exclude, for example, other additives, components, integers or steps. "Exemplary" means "an example of" and is not intended to convey an indication of a preferred or ideal embodiment. "Such as" is not used in a restrictive sense, but for explanatory purposes.

Disclosed are components that can be used to perform the disclosed methods and systems. These and other components are disclosed herein, and it is understood that when combinations, subsets, interactions, groups, etc. of these components are disclosed that while specific reference of each various individual and collective combinations and permutation of these may not be explicitly disclosed, each is specifically contemplated and described herein, for all methods and systems. This applies to all aspects of this application including, but not limited to, steps in disclosed methods. Thus, if there are a variety of additional steps that can be performed it is understood that each of these additional steps can be performed with any specific embodiment or combination of embodiments of the disclosed methods.

The invention claimed is:

1. A device comprising:

a foot support having an upper surface and a lower surface, the upper and lower surfaces being spaced apart and opposite each other, the foot support comprising a proximal end, a distal end opposite and spaced apart from the proximal end, a first side, and a second side opposite and spaced apart from the first side, wherein the first and second sides extend between the proximal and distal ends, and the foot support further comprising a heel portion adjacent the proximal end;

a base; and a coupling disposed between the base and the lower surface of the foot support adjacent the heel portion of the foot support, the coupling having a first axis of rotation, a second axis of rotation, and a third axis of rotation, the first axis of rotation, the second axis of rotation and the third axis of rotation being orthogonal to each other, wherein a first foot support axis that extends between the proximal and distal ends of the foot support is rotatable about the first axis of rotation and the third axis of rotation, and a second foot support axis that extends between the first and second sides of the foot support is rotatable about the second axis of rotation, wherein the coupling comprises a universal joint, the universal joint comprising a center portion, a proximal arm, a distal arm, a first side arm, and a second side arm, wherein the proximal arm and distal arm extend in opposite directions along the second axis of rotation, and the first side arm and the second side arm extend in opposite directions along the third axis of rotation, and wherein the coupling further comprises a first universal joint support member and a second universal joint support member, the first and second universal joint support members being fixedly coupled to the lower surface of the foot support, the first universal joint support member defining an opening for receiving a proximal arm of a universal joint, and the second universal joint support member defining an opening for receiving a distal arm of the universal joint.

2. The device of claim 1, wherein the foot support is rotatable about the coupling and at least one of the axes of rotation between a neutral position and a plurality of rotated positions, wherein the neutral position comprises:

the first foot support axis being orthogonal to the first axis of rotation and the third axis of rotation and parallel to the second axis of rotation, and the second foot support axis being parallel to the third axis of rotation and orthogonal to the first axis of rotation and the second axis of rotation and wherein the rotated positions comprise:

a twisting rotated position wherein the first foot support axis is rotated about the first axis of rotation such that the first foot support axis and the second axis of rotation are in parallel planes and an angle between the first foot support axis and the second axis of rotation is greater than 0°, a rolling rotated position wherein the second foot support axis is rotated about the second axis of rotation such that the second foot support axis and the third axis of rotation are in parallel planes and an angle between the second foot support axis and the third axis of rotation is greater than 0°, and a flexing rotated position wherein the first foot support axis is rotated about the third axis of rotation such that the first foot support axis and the second axis of rotation are in parallel planes and an angle between the first foot support axis and the second axis of rotation is greater than 0°.

3. The device of claim 2, further comprising first and second rotational stops, the first and second rotational stops being disposed on the base such that the first and second rotational stops limit the angle through which the first foot support axis is able to rotate about the first axis of rotation from the neutral position to the twisting rotated position.

4. The device of claim 3, wherein the angle through which the first foot support axis is able to rotate about the first axis of rotation from the neutral position to the twisting rotated position is about 30° from each side of the neutral position.

5. The device of claim 2, further comprising third and fourth rotational stops, the third and fourth rotational stops being disposed adjacent the lower surface of the foot support such that the third and fourth rotational stops limit the angle through which the second foot support axis is able to rotate about the second axis of rotation from the neutral position to the rolling rotated position.

6. The device of claim 5, wherein the angle through which the second foot support axis is able to rotate about the second axis of rotation from the neutral position to the rolling rotated position is about 30° from each side of the neutral position.

7. The device of claim 2, further comprising fifth and sixth rotational stops, the fifth and sixth rotational stops being disposed on the base such that the fifth and sixth rotational stops limit the angle through which the first foot support axis is able to rotate about the third axis of rotation from the neutral position to the flexing rotated position.

8. The device of claim 7, wherein the angle through which the first foot support axis is able to rotate about the third axis of rotation from the neutral position to the flexing rotated position is about 30° in a direction in which the distal end of the foot support is moved upwardly from the neutral position and about 50° in a direction in which the distal end is moved downwardly from the neutral position.

9. The device of claim 1, wherein the coupling further comprises a bearing disposed between the center portion of the universal joint and the lower surface of the foot support, wherein the first axis of rotation extends through the bearing and the center portion.

10. The device of claim 1, wherein the coupling further comprises a third universal joint support member and a fourth universal joint support member, the third and fourth universal joint support members being fixedly coupled to the base, the third universal joint support member defining an opening for receiving the first side arm of the universal joint, and the fourth universal joint support member defining an opening for receiving the second side arm of the universal joint.

11. The device of claim 1, wherein the foot support further comprises a plurality of strap supports adjacent the proximal end and a middle region of the foot support, the middle region being between the proximal end and a distal end of the foot support, the strap supports defining openings for receiving one or more straps to secure a user's foot adjacent the upper surface of the foot support, wherein the strap supports adjacent the middle region comprise a medial strap support and a lateral strap support, the medial and lateral strap supports being configured to slide inwardly toward each other or outwardly away from each other.

12. The device of claim 1, wherein the foot support comprises a first boss adjacent a distal side of the foot support and a second boss adjacent one of the first or second sides of the foot support, the first boss having an axis that is parallel to the second axis of rotation, and the second boss having an axis that is parallel to the third axis of rotation, wherein the first and second bosses are configured for removably receiving a handle for manipulating rotation of the foot support about the first axis of rotation, the second axis of rotation and the third axis of rotation.

13. The device of claim 1, wherein the foot support comprises a handle extending from the distal end.

14. The device of claim 1, wherein the base comprises a lower support and an upper support that extends between the lower support and the coupling, wherein the upper support is an arm, wherein the arm is a main arm and the base further comprises a swing arm, the swing arm having a first portion that is coupled between the coupling and the lower surface of the foot support and a second portion that extends between the first portion and a free end, the free end of the swing arm configured for swinging right or left in response to rotating the foot support about the second axis of rotation or backward and forward in response to rotating the foot support about the third axis of rotation.

15. The device of claim 14, wherein the coupling further comprises an opening defined by the first portion of the swing arm, a boss extending from the lower surface of the foot support that extends through the opening defined by the first portion of the swing arm, a protrusion that extends from the center portion of the coupling, and a bearing disposed between an outer surface of the boss and the opening of the first portion of the swing arm.

16. The device of claim 15, the coupling further comprising a second bearing disposed between the protrusion and an inner surface of the boss.

17. The device of claim 14, further comprising a first lock comprising a removable pin, an opening defined by the swing arm, and an opening adjacent a proximal end of the foot support, wherein the pin is removably engagable into the openings defined by the swing arm and the proximal end of the foot support to prevent rotation about the first axis of rotation.

18. The device of claim 17, further comprising a second lock comprising a closed loop pneumatic system, the closed loop pneumatic system comprising a rod having a distal end coupled to the second axis of the coupling via a linkage and a proximal end moveable within a pneumatic cylinder, the cylinder being coupled to the swing portion of the swing arm.

19. The device of claim 17, further comprising a third lock comprising a closed loop pneumatic system, the closed loop pneumatic system comprising a rod having a distal end coupled to the third axis of the coupling via a linkage and a proximal end moveable within a pneumatic cylinder, the pneumatic cylinder being coupled to the lower support at a proximal end of the pneumatic cylinder.

20. A device comprising:

a foot support having an upper surface and a lower surface, the upper and lower surfaces being spaced apart and opposite each other, the foot support comprising a proximal end, a distal end opposite and spaced apart from the proximal end, a first side, and a second side opposite and spaced apart from the first side, wherein the first and second sides extend between the proximal and distal ends, and the foot support further comprising a heel portion adjacent the proximal end;

a base;

a coupling disposed between the base and the lower surface of the foot support adjacent the heel portion of the foot support, the coupling having a first axis of rotation, a second axis of rotation, and a third axis of rotation, the first axis of rotation, the second axis of rotation and the third axis of rotation being orthogonal to each other; and a first lock for preventing rotation of the foot support about the first axis of rotation, wherein the first lock comprises a removable pin, an opening defined by the base, and an opening adjacent a proximal end of the foot support, wherein the pin is removably engagable into the openings defined by the base and the proximal end of the foot support to prevent rotation about the first axis of rotation, wherein a first foot support axis that extends between the proximal and distal ends of the foot support is rotatable about the first axis of rotation and the third axis of rotation, and a second foot support axis that extends between the first and second sides of the foot support is rotatable about the second axis of rotation.

21. The device of claim 20, further comprising a second lock for preventing rotation of the foot support about the second axis of rotation, wherein the second lock comprises a closed loop pneumatic system, the closed loop pneumatic system comprising a rod having a distal end coupled to the third axis of the coupling via a linkage and a proximal end moveable within a pneumatic cylinder, the pneumatic cylinder having a first port adjacent a distal end of the cylinder and a second port adjacent a proximal end of the cylinder, and the pneumatic system further comprising conduits in fluid communication between the first and second ports and each end of an expansion bladder and in fluid communication with a valve, wherein movement of the proximal end of the rod toward the proximal end of the cylinder causes gas in the system to expand the bladder, and wherein the second lock prevents movement of the foot support about the second axis of rotation when the valve is closed, wherein the second lock provides resistance to and allows rotation of the foot support about the second axis of rotation when the valve is open.

22. The device of claim 21, further comprising a third lock for preventing rotation of the foot support about the third axis of rotation, wherein the third lock comprises a closed loop pneumatic system, the closed loop pneumatic system comprising a rod having a distal end coupled to the second axis of the coupling via a linkage and a proximal end moveable within a pneumatic cylinder, the pneumatic cylinder having a first port adjacent a distal end of the cylinder and a second port adjacent a proximal end of the cylinder, and the pneumatic system further comprising conduits in fluid communication between the first and second ports and each end of an expansion bladder and in fluid communication with a valve, wherein movement of the proximal end of the rod toward the proximal end of the cylinder causes gas in the system to expand the bladder, and wherein the third lock prevents movement of the foot support about the third axis of rotation when the valve is closed, wherein the third lock provides resistance to and allows rotation of the foot support about the third axis of rotation when the valve is open.

* * * * *